US007413840B1

(12) United States Patent
Ogaki et al.

(10) Patent No.: US 7,413,840 B1
(45) Date of Patent: Aug. 19, 2008

(54) PROCESS FOR FORMING AN ELECTROPHOTOGRAPHIC PHOTOSENSITIVE MEMBER WITH DEPRESSED PORTIONS BY CONDENSING A SURFACE OF A SURFACE LAYER ON WHICH A COATING LIQUID IS PRESENT

(75) Inventors: Harunobu Ogaki, Suntoh-gun (JP); Atsushi Ochi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/770,081

(22) Filed: Jun. 28, 2007

Related U.S. Application Data

(63) Continuation of application No. PCT/JP2007/060651, filed on May 18, 2007.

(30) Foreign Application Priority Data

Jan. 26, 2007 (JP) ..... 2007/016215
May 2, 2007 (JP) ..... 2007/121499

(51) Int. Cl.
*G03G 5/147* (2006.01)

(52) U.S. Cl. ..... 430/132; 430/133; 430/134

(58) Field of Classification Search ..... 430/132, 430/133, 134, 131
See application file for complete search history.

(56) References Cited

U.S. PATENT DOCUMENTS 4,804,607 A * 2/1989 Atsumi ..... 430/132
5,449,573 A * 9/1995 Aoki et al. ..... 430/131
5,550,000 A * 8/1996 Takegawa et al. ..... 430/131
2002/0001767 A1 * 1/2002 Kawamorita et al. ..... 430/133
2007/0281239 A1 12/2007 Uematsu et al. ..... 430/133

FOREIGN PATENT DOCUMENTS

| | | |
|---|---|---|
| AU | B-74127/94 | 4/1995 |
| JP | 53-092133 | 8/1978 |
| JP | 02-150850 | 6/1990 |
| JP | 07-097218 | 4/1995 |
| JP | 2000-010303 | 1/2000 |
| JP | 2001-175008 | 6/2001 |

* cited by examiner

*Primary Examiner*—Christopher RoDee
(74) *Attorney, Agent, or Firm*—Fitzpatrick, Cella, Harper & Scinto

(57) ABSTRACT

A production method of an electrophotographic photosensitive member which has high productivity when producing a surface layer in which depressed portions which are independent respectively are formed on an electrophotographic photosensitive member surface, and can produce highly uniform depressed portions in a photosensitive member surface, characterized by producing the surface layer by (1) a coating step of producing a coating liquid for a surface layer containing a binder resin and a specific solvent, and coating it on a surface of a cylindrical supporting member, (2) a condensation step of holding the cylindrical supporting member on which the coating liquid for a surface layer is coated, and condensing the surface of the cylindrical supporting member, and (3) a drying step of baking the cylindrical supporting member.

7 Claims, 5 Drawing Sheets

PROCESS FOR FORMING AN ELECTROPHOTOGRAPHIC PHOTOSENSITIVE MEMBER WITH DEPRESSED PORTIONS BY CONDENSING A SURFACE OF A SURFACE LAYER ON WHICH A COATING LIQUID IS PRESENT

This application is a continuation of International Application No. PCT/JP2007/060651, filed May 18, 2007, which claims the benefit of Japanese Patent Applications No. 2007-016215, filed Jan. 26, 2007, and No. 2007-121499, filed May 2, 2007.

BACKGROUND OF THE INVENTION

1. Field of the Invention

The present invention relates to a production method of an electrophotographic photosensitive member.

2. Description of the Related Art

Recently, research and development of electrophotographic photosensitive members (organic electrophotographic photosensitive members) using organic photoconductive substances have been conducted briskly.

Fundamentally, an electrophotographic photosensitive member includes a supporting member and a photosensitive layer formed on the supporting member. The photosensitive layer which constructs an organic electrophotographic photosensitive member uses a charge generation material and a charge transport material as a photoconductive material, and uses a binder resin as a resin which binds these materials. As layer structure of the photosensitive layer, there are laminated structure that respective functions are functionally separated into a charge generation layer and a charge transport layer, and monolayer structure that these materials are made to be solved or dispersed in a monolayer. Most electrophotographic photosensitive members adopt construction of a laminated photosensitive member, in this case, a charge transport layer becomes a surface layer in many cases, and a protective layer may be provided in order to make the surface layer highly durable.

Since a surface layer of an electrophotographic photosensitive member (hereinafter, simply a "photosensitive member" in some case) is a layer in contact with various members or a sheet, various functions such as mechanical strength or chemical stability of a material which constructs the surface layer to contact are requested. Many proposals for these requests have been made from an aspect of improvement of materials which construct a surface layer.

Among the above-mentioned proposals, a proposal of functional enhancement of a photosensitive member surface by performing convexoconcave processing of the photosensitive member surface is made. For example, in Japanese Patent Publication No. H07-97218, a production method of a photosensitive member which forms a trench in a surface by surface finishing which makes film-shaped abrasive rub with the photosensitive member surface is disclosed. In addition, in Japanese Patent Application Laid-Open No. H02-150850, a proposal of producing a depressed portion on a surface by performing sandblast treatment is made. Although Japanese Patent Publication No. H07-97218, and Japanese Patent Application Laid-Open No. H02-150850 are production methods of processing a photosensitive member surface after formation of the photosensitive member surface, as another method, a photosensitive member that a convexoconcave form is produced on a photosensitive member surface in a forming step of a surface layer of the photosensitive member is disclosed (Japanese Patent Application Laid-Open No. S52-92133).

While a photosensitive member that a convexoconcave form is formed in a photosensitive member surface like Japanese Patent Application Laid-Open No. S52-92133 is proposed, a production method of not forming a liquid droplet trace in a photosensitive member surface is disclosed in Japanese Patent Application Laid-Open No. 2000-10303. Description in Japanese Patent Application Laid-Open No. 2000-10303 points out that a surface condenses with heat of vaporization of a solvent at the time of photosensitive layer coating, traces of condensation occurring at that time remain as pores in a photosensitive member surface, and they are a factor of black spots on an image, and toner filming. Japanese Patent Application Laid-Open No. 2001-175008 also expresses a production method of a photosensitive member which prevents whitening by the same condensation as that in Japanese Patent Application Laid-Open No. 2000-10303.

SUMMARY OF THE INVENTION

Japanese Patent Publication No. H07-97218, and Japanese Patent Application Laid-Open No. H02-150850 aim at functional enhancement of a photosensitive member surface by performing processing of forming a convexoconcave form in the photosensitive member surface. Nevertheless, since a step of processing the surface is necessary after an electrophotographic photosensitive member once produced, these methods cannot be said to be sufficient as production methods in view of productivity. Furthermore, it cannot be said that these surface finishing methods are processing methods for obtaining a highly uniform surface, and when a processed area becomes a range which is about several micrometers, uniformity in a fine area is not obtained, and hence, improvement is desired in respect of functional enhancement.

In Japanese Patent Application Laid-Open No. S52-92133, although a convexoconcave form is produced in a photosensitive member surface at a forming step of a surface layer of the photosensitive member and it can be said that it excels in respect of productivity, it is expressed that the convexoconcave form produced by this production method is a surface in a loose waveform In Japanese Patent Application Laid-Open No. S52-92133, although it is described that enhancement of cleaning property and wear resistance can be achieved, when the wave form becomes a range which is about several micrometers, uniformity in a fine area is not obtained, and hence, improvement is desired in respect of functional enhancement.

Japanese Patent Application Laid-Open No. 2000-10303, and Japanese Patent Application Laid-Open No. 2001-175008 express production methods that a surface condenses with heat of vaporization of a solvent at the time of photosensitive layer coating, but traces of condensation occurring at that time do not remain as pores in a photosensitive member surface, and advantages of the convexoconcave form not being formed in a photosensitive layer surface are described. Nevertheless, functionality of the photosensitive member in whose surface the convexoconcave form is formed is described in Japanese Patent Application Laid-Open No. S52-092133, it is suggested that it may have an advantage that the convexoconcave form is formed in the surface. Hence, development of a production method of an electrophotographic photosensitive member which can give functionality without causing a malfunction as a photosensitive member by suitable convexoconcave formation being made is desired.

A task of the present invention is to provide a production method of an electrophotographic photosensitive member which has high productivity when producing a surface layer in which depressed portions which are independent respectively are formed on a photosensitive member surface, and can produce a highly uniform depressed portion in the photosensitive member surface.

In a production method of an electrophotographic photosensitive member which has a photosensitive layer on a cylindrical supporting member, the present invention relates to a production method of an electrophotographic photosensitive member characterized by producing a surface layer on whose surface depressed portions which are independent respectively are formed, by:

(1) a coating step of producing a coating liquid for a surface layer which contains a binder resin and the aromatic organic solvent whose dipole moment found by dipole moment calculation by the structure optimized-calculation using semiempirical molecular orbital calculation is 1.0 or less, and in which the content of an aromatic organic solvent is 50% by mass or more and 80% by mass or less based on the total mass of solvents in the coating liquid for a surface layer, and coating the coating liquid for a surface layer on a surface of the cylindrical supporting member, (2) a condensation step of holding the cylindrical supporting member on which the surface layer coating liquid is coated, and condensing a surface of the cylindrical supporting member on which the coating liquid for a surface layer is coated, and (3) a drying step of drying the cylindrical supporting member after the condensation step.

According to the present invention, it can be performed to provide a production method of an electrophotographic photosensitive member which has high productivity when producing a surface layer that depressed portions which are independent respectively are formed in a photosensitive member surface, and can produce a highly uniform depressed portion in the photosensitive member surface.

Further features of the present invention will become apparent from the following description of exemplary embodiments with reference to the attached drawings.

DESCRIPTION OF THE EMBODIMENTS

Figure 1A:
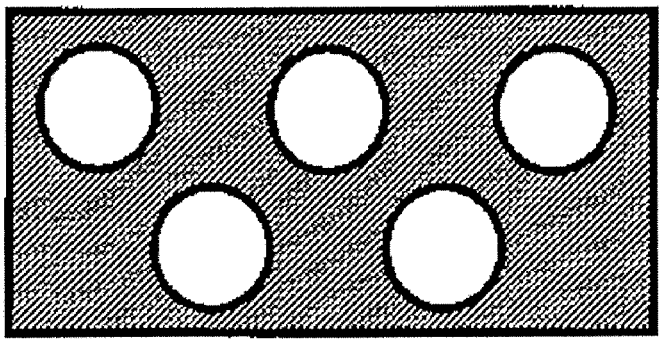
FIG. 1A illustrates one form in surface observation of a depressed portion of the present invention.

Hereafter, the present invention will be described in detail.

In a production method of an electrophotographic photosensitive member which has a photosensitive layer on a cylindrical supporting member, as described above, a production method of an electrophotographic photosensitive member of the present invention is a production method of an electrophotographic photosensitive member characterized by producing a surface layer on whose surface depressed portions which are independent respectively are formed, by:

(1) a coating step of producing a coating liquid for a surface layer which contains a binder resin and the aromatic organic solvent whose dipole moment found by dipole moment calculation by the structure optimized-calculation using semiempirical molecular orbital calculation is 1.0 or less, and in which content of an aromatic organic solvent is 50% by mass or more and 80% by mass or less based on the total mass of solvents in the coating liquid for a surface layer, and coating the coating liquid for a surface layer on a surface of a cylindrical supporting member, (2) a condensation step of holding the cylindrical supporting member on which the surface layer coating liquid is coated, and condensing a surface of the cylindrical supporting member on which the coating liquid for a surface layer is coated, and (3) a drying step of drying a cylindrical member after the condensation step.

The surface layer in the present invention means a photosensitive layer when the photosensitive layer is a monolayer type photosensitive layer. In addition, it means a charge transport layer when a photosensitive layer is a normal layer type photosensitive layer that a charge generation layer and the charge transport layer are stacked in this order from a cylindrical supporting member side. Furthermore, it means a charge generation layer when a photosensitive layer is a reverse layer type photosensitive layer that a charge transport layer and the charge generation layer are stacked in this order from a cylindrical supporting member side.

In addition, in the case of having a protective layer on a photosensitive layer, a surface layer in the present invention means a protective layer A coating step of producing a coating liquid for a surface layer which contains a binder resin and the aromatic organic solvent whose dipole moment found by dipole moment calculation by the structure optimized-calculation using semiempirical molecular orbital calculation is 1.0 or less, and in which content of an aromatic organic solvent is 50% by mass or more and 80% by mass or less based on the total mass of solvents in the coating liquid for a surface layer, and coating the coating liquid for a surface layer on a surface of a cylindrical supporting member, which is described in (1), in the present invention will be described.

The production method of the present invention is characterized by stably forming depressed portions by condensation, and producing highly uniform depressed portions in a photosensitive member surface. In order to produce highly uniform depressed portions stably, it is important to produce a surface layer of a photosensitive member using the surface layer coating liquid expressed in (1).

It is necessary for a production method of producing highly uniform depressed portions of the present invention stably to contain a binder resin in a coating liquid. As the binder resin in the present invention, for example, an acrylic resin, a styrene resin, a polyester resin, a polycarbonate resin, a polyarylate resin, a polysulphone resin, a polyphenylene oxide resin, an epoxy resin, a polyurethane resin, an alkyd resin, or an unsaturated resin is cited. In particular, the polymethyl methacrylate resin, polystyrene resin, styrene acrylonitrile copolymer resin, polycarbonate resin, polyarylate resin, or diallyl phthalate resin is suitable. Furthermore, the resin is suitably the polycarbonate resin or polyarylate resin. As for these, they can be used alone, or two or more kinds can be used as a mixture or a copolymer. It is suitable that the content of a binder resin in a coating liquid for a surface layer is 5% by mass or more and 20% by mass or less based on the total mass of solvents in the coating liquid for a surface layer, since it gives moderate viscosity to the coating liquid for a surface layer and it enables to form depressed portions stably. As described above, since the coating liquid for a surface layer contains the binder resin, the depressed portions formed in the condensation step expressed in (2) and in the drying condensation step expressed in (3) can be stably formed in a surface.

For the production method of stably producing highly uniform depressed portions according to the present invention, it is important that a surface layer coating liquid contains an aromatic organic solvent whose dipole moment found by dipole moment calculation by the structure optimized-calculation using semiempirical molecular orbital calculation is 1.0 or less.

The dipole moment calculation by the structure optimized-calculation using the semiempirical molecular orbital calculation in the present invention means a structure optimized-calculation using a semiempirical molecular orbital calculation using a PM3 parameter. In the molecular orbital method, a wave function used in a Schrodinger equation is approximated by a Slater determinant or a Gaussian determinant which includes molecular orbitals expressed by the linear combination of atomic orbitals, and a molecular orbital which constructs the wave function is found using approximation of a field. In consequence, various physical quantities are calculable as total energy, a wave function, and an expectation value of a wave function.

When finding a molecular orbital by approximation of a field, what reduces computer time by approximating integration calculation, which needs long computer time, using parameters using various experimental values is the semiempirical molecular orbital method. In the calculation in the present invention, calculation was performed using a semiempirical molecular orbital calculation program MOPAC using a PM3 parameter set as semiempirical parameters. The dipole moment of the aromatic organic solvent was calculated by the structure optimized-calculation using the above-described semiempirical molecular orbital calculation using the PM3 parameter.

Dipole Moment Calculation by Structure Optimized-Calculation Using Semiempirical Molecular Orbital Calculation>

A workstation INDIGO2 (made by Silicon Graphics Inc.) was used as a computer, and Cerius2 which was integrated chemical calculation software was used for dipole moment calculation.

Molecular structure was produced by a Skecher function, which was in Cerius2, about a solvent which became as a calculation object, force field calculation was performed to the molecular structure using a DREDING2.21 program, and electric charge calculation was performed by a CHARGE function. Then, structure was rationalized by molecular force field calculation by Minimizer calculation. The PM3 parameters, Geometry Optimization and Dipole are specified for the obtained structure to a MOPAC93 program, and structure rationalization and dipole moment calculation were performed using the PM3 parameter set.

Hereafter, the "dipole moment" used in this specification means dipole moment found by the above-described dipole moment calculation by the structure optimized-calculation using the semiempirical molecular orbital calculation.

Liquid droplets are formed near a surface of a photosensitive layer by condensation in the condensation step expressed in (2) by containing the aromatic organic solvent whose dipole moment is 1.0 or less in a surface layer coating liquid. On this occasion, since the solvent with low affinity to water is had in the surface layer coating liquid, liquid droplets are stably formed near the surface of the photosensitive layer. Since having low affinity to water, an aromatic organic solvent can form liquid droplets stably. When an aromatic organic solvent whose dipole moment is 1.0 or less is contained among aromatic organic solvents, formation of depressed portions is performed stably. A dipole moment shows polarity inside solvent molecules, and when its value is small, it shows that they are low polar molecules. In the present invention, liquid droplets of water are formed on a surface by the condensation in the condensation step expressed in (2). On this occasion, since the solvent with low affinity to water is had in the surface layer coating liquid, liquid droplets are stably formed near the surface. Since affinity to water has relevance to magnitude of dipole moment and the aromatic organic solvent with a small value of dipole moment has low affinity to water, it becomes important that it is had in the coating liquid for a surface layer according to the present invention.

Specific examples of the aromatic organic solvents, whose dipole moment is 1.0 or less, in the present invention, dipole moment, and values of boiling points under an atmospheric pressure are shown in Table 1. (The solvent A in Table 1 shows the aromatic organic solvents, whose dipole moment is 1.0 or less, in the present invention. The dipole moment shows dipole moment found by the dipole moment calculation by the structure optimized-calculation using the semiempirical molecular orbital calculation of a target solvent. The boiling point shows a boiling point of a target solvent under an atmospheric pressure. The boiling point of each solvent is extracted from Newly Edited Solvent Handbook, Ohmsha, Ltd., Jun. 10, 1994.)

TABLE 1

| | Name | Boiling point [° C.] | Dipole moment [Debye] |
|---|---|---|---|
| Solvent A | Benzene | 80 | 0.00 |
| | Methylbenzene | 111 | 0.26 |
| | Chlorobenzene | 133 | 0.74 |
| | 1,2-dimethylbenzene | 144 | 0.46 |
| | 1,3-dimethylbenzene | 139 | 0.24 |
| | 1,4-dimethylbenzene | 138 | 0.07 |
| | Ethylbenzene | 136 | 0.33 |
| | 1,3,5-Trimethylbenzene | 165 | 0.12 |

Although all can be adapted for the production method of the present invention so long as they are solvents shown in the solvent A in Table 1, among them, it is suitable that they are 1,2-dimethylbenzene, 1,3-dimethylbenzene, 1,4-dimethylbenzene, 1,3,5-trimethylbenzene, or chlorobenzene. These aromatic organic solvents can be contained independently, or can be contained with two or more kinds of them being mixed The production method of the present invention coats a surface layer using a coating liquid for a surface layer which contains an aromatic organic solvent, whose dipole moment is 1.0 or less, by 50% by mass or more and 80% by mass or less based on the total mass of solvents in the coating liquid for a surface layer, in the surface layer coating liquid. When content of the aromatic organic solvent, whose dipole moment is 1.0 or less, in the present invention based on the total mass of solvents in the coating liquid for a surface layer is less than 50% by mass, highly uniform depressed portions are not formed in the photosensitive member surface. This relates to that it is important that, for formation of the depressed portions of the present invention, water acts and a coating liquid for a surface layer with low affinity to water is constructed. That is, it is conceivable that it depends on that, when the content of the aromatic organic solvent whose affinity to water is low, and whose dipole moment is 1.0 or less is little, a sufficient hydrophobic effect cannot be obtained, and hence, formation of highly uniform depressed portions is hard. Also when the content of the aromatic organic solvent, whose dipole moment is 1.0 or less, in the present invention based on the total mass of solvents in the coating liquid for a surface layer is more than 80% by mass, highly uniform depressed portions are not formed in the photosensitive member surface. Although this reason is unknown for details, it is conceivable that, although the hydrophobic effect of the aromatic organic solvent to water of the coating liquid for a surface layer is high, the water and aromatic organic solvent have relation of performing an azeotrope generally, and hence, some of the aromatic organic solvents and the water perform the azeotrope, or evaporation together at the time of drying the coating liquid for a surface layer of the present invention in the drying step expressed in (3), and hence, formation of the depressed portions are not performed, or they are inferior in uniformity although formation of the depressed portions are performed.

It is important that an aromatic organic solvent whose dipole moment is 1.0 or less is contained in a surface layer coating liquid according to the present invention. Furthermore, in order to produce depressed portions stably, it is also sufficient to contain an aromatic organic solvent, whose dipole moment is 2.8 or more, in a range of 0.1% by mass or more and 15.0% by mass or less based on the total mass of solvents in the surface layer coating liquid, in the surface layer coating liquid. Since the organic solvent whose dipole moment is 2.8 or more has large polarization inside molecules, its affinity to water is high. It is conceivable that this effect contributes to stabilization of the liquid droplets of water or formation of the highly uniform depressed portions formed by the condensation in the condensation step of the present invention which is expressed in (2). Although details are unknown, it is conceivable that it enhances adsorptivity of water at the time of the condensation to contain the organic solvent, which has large dipole moment in the surface layer coating liquid, or it forms highly uniform depressed portions that the organic solvent which has large dipole moment melts into the liquid droplets formed.

Specific examples of the aromatic organic solvents, whose dipole moment is 2.8 or more, in the present invention, dipole moment, and values of boiling points under an atmospheric pressure are shown in Table 2. (The solvent B in Table 2 shows the organic solvents, whose dipole moment is 2.8 or more, in the present invention. The dipole moment shows dipole moment found by the dipole moment calculation by the structure optimized-calculation using the semiempirical molecular orbital calculation of a target solvent. The boiling point shows a boiling point of a target solvent under an atmospheric pressure. The boiling point of each solvent is extracted from Newly Edited Solvent Handbook, Ohmsha, Ltd., Jun. 10, 1994.)

TABLE 2

| | Name | Boiling point [° C.] | Dipole moment [Debye] |
|---|---|---|---|
| Solvent B | 2-methylpentane-2,4-diol | 197 | 2.81 |
| | 3-(3-hydroxypropoxy)propane-1-ol | 232 | 3.92 |
| | 3-(3-methoxypropoxy)propane-1-ol | 190 | 3.68 |
| | 3-(3-ethoxypropoxy)propane-1-ol | 198 | 3.61 |
| | 3-[3-(3-methoxypropoxy)propoxy]propane-1-ol | 243 | 4.74 |
| | 1,3-dioxolane-2-one | 238 | 4.62 |
| | 4-methyl-1.3-dioxolane-2-one | 242 | 4.81 |
| | 2-methoxyethyl acetate | 145 | 3.04 |
| | N,N-dimethylcarboxyamide | 153 | 3.44 |
| | N,N-diethylcarboxyamide | 177 | 3.39 |
| | N,N-dimethylacetamide | 166 | 3.21 |
| | 1-methylpyrrolidine-2-one | 202 | 3.31 |
| | (Methylsulfinyl)Methane | 189 | 4.48 |
| | Thiolane-1,1-dione | 287 | 4.97 |
| | Phosphino-tris(dimethylamino)-1-one | 233 | 2.80 |
| | 1,3-Dimethyl-Imidazolidine-2-one | 226 | 3.47 |

Furthermore, as the above-mentioned organic solvent, it is suitable to produce highly uniform depressed portions that it is an organic solvent whose dipole moment is 3.2 or more.

All can be adapted for the production method of the present invention so long as they are solvents shown in the solvent B in Table 2. In particular, (methylsulfinyl)Methane (trivial name: dimethyl sulfoxide), thiolane-1,1-dione (trivial name: sulfolane)N,N-dimethylcarboxyamide, N,N-diethylcarboxyamide, dimethylacetamide, or 1-methylpyrrolidine-2-one is suitable. These organic solvents can be contained independently, or can be contained with two or more kinds of them being mixed.

As content of the above-described organic solvent whose dipole moment is 2.8 or more, it is suitable that it is 0.1% by mass or more and 15.0% by mass or less based on the total mass of solvents in the coating liquid for a surface layer. Furthermore, in order to improve the uniformity of the depressed portions, it is suitable that the content of the organic solvent is 0.2% by mass or more and 5.0% by mass or less based on the total mass of solvents in the coating liquid for a surface layer.

It is suitable that the boiling point of the above-described organic solvents whose dipole moment is 2.8 or more is equal to or more than the boiling point of the aromatic organic solvents whose dipole moment is 1.0 or less.

It is conceivable that an effect of the organic solvent, whose dipole moment is 2.8 or more, in the production method of the present invention contributes to stabilization of the liquid droplets of water or formation of the highly uniform depressed portions formed by the condensation in the condensation step of the present invention which is expressed in (2). At this time, it is conceivable that it contributes to the formation of the highly uniform depressed portions by an organic solvent with high affinity to water and a high boiling point existing when an aromatic organic solvent with a low boiling point is removed from the coating liquid in the drying step of the present invention which is expressed in (3) that the boiling point of the organic solvents whose dipole moment is 2.8 or more is higher than the boiling point of the aromatic organic solvents whose dipole moment is 1.0 or less.

The organic solvent whose dipole moment is 2.8 or more is preferably removed from the surface layer after preparing the photosensitive member having the surface layer of the present invention, but such organic solvent may remain in the surface layer as far as photosensitive member properties are not inhibited.

It is important that an aromatic organic solvent whose dipole moment is 1.0 or less is contained in a surface layer coating liquid according to the present invention. Furthermore, in order to produce depressed portions stably, it is also sufficient to contain water in a range of 0.1% by mass or more and 2.0% by mass or less based on the total mass of solvents in the coating liquid for a surface layer, in the surface layer coating liquid. It is conceivable that it contributes to stabilization of the liquid droplets of water or formation of the highly uniform depressed portions formed by the condensation in the condensation step of the present invention which is expressed in (2) that water is made to be contained in the surface layer coating liquid. Furthermore, in order to improve the uniformity of the depressed portions, it is suitable that the content of water is 0.2% by mass or more and 1.0% by mass or less based on the total mass of solvents in the coating liquid for a surface layer.

The water in the surface layer coating liquid is preferably removed from the surface layer after preparing the photosensitive member having the surface layer of the present invention, but the water may remain in the surface layer as far as the photosensitive member properties are not inhibited.

At a coating step of coating a coating liquid for a surface layer on a surface of the cylindrical supporting member expressed in (1) in the present invention, for example, a coating method such as a dip coating method, a spray coating method, or a ring coating method can be used. It is suitable to be the dip coating method from an aspect of productivity.

Subsequently, the condensation step of holding the cylindrical supporting member on which the surface layer coating liquid is coated, and condensing a surface of the cylindrical supporting member on which the surface layer coating liquid is coated, the condensation step which is expressed in (2) in the present invention will be described.

This step means a step of holding a cylindrical supporting member, on which a surface layer coating liquid is coated at the coating step, expressed in the above-described (1), under an ambient atmosphere in which a surface of the cylindrical supporting member condenses. The condensation in the present invention means that liquid droplets are formed on a cylindrical supporting member, on which a surface layer coating liquid is coated, by an action of water. In order to form liquid droplets by the action of water, for example, methods expressed below are cited.

(a) By surface cooling by heat of vaporization of a solvent used for a coating liquid and adjustment of temperature and relative humidity conditions of an ambient atmosphere, surrounding water is made to adhere to a supporting member surface, and liquid droplets are made to be formed by cohesion of water.

(b) By making a solvent with high affinity to water contained in a coating liquid, water is made to adhere efficiently at the time of surface cooling by the heat of vaporization of the solvent used for the coating liquid, and liquid droplets are made to be formed by the cohesion of water.

(c) By making a solvent with high affinity to water contained in a coating liquid, the solvent with high affinity which is used for the coating liquid takes in water in the ambient atmosphere in the condensation step, and liquid droplets are made to be formed by the cohesion of water which is taken in.

(d) By making water contained in a coating liquid, water is made to adhere efficiently at the time of surface cooling by the heat of vaporization of the solvent used for the coating liquid, and liquid droplets are made to be formed by the cohesion of water (e) By making water contained in a coating liquid, the water which is used for the coating liquid takes in water in the ambient atmosphere in the condensation step, and liquid droplets are made to be formed by the cohesion of water in the coating liquid and the water which is taken in.

Conditions for making a surface of a cylindrical supporting member, on which a surface layer coating liquid is coated, condensation are affected by relative humidity of an ambient atmosphere, where the cylindrical supporting member is held, and volatilization conditions (for example, heat of vaporization) of a coating liquid solvent. Nevertheless, since an aromatic organic solvent is contained by 50% or more by mass of based on the total mass of solvents in a surface layer coating liquid in the present invention, there is little influence of the volatilization conditions of the coating liquid solvent, and hence, it is mainly dependent on the relative humidity of the ambient atmosphere where a cylindrical supporting member is held. The relative humidity which a surface of the cylindrical supporting member in the present invention is made to condensation is 40% or more and 100% or less. When not making a solvent with high affinity to water contained in a surface layer coating liquid, a relative humidity is further preferably 70% or more.

In addition, in order to promote surface cooling by heat of vaporization of a solvent used for a surface layer coating liquid, it is sufficient to use means of cooling a coating liquid below room temperature at the step of coating the surface layer coating liquid to promote condensation.

The condensation step in the present invention may be performed after the coating step of coating a surface layer coating liquid on a surface of a cylindrical supporting member which is expressed in (1) of the present invention, or may be performed just after coating a surface layer coating liquid. When the condensation step is performed after an end of the step of coating the surface layer coating liquid on the surface of the cylindrical supporting member, time may be provided between an end of the coating step expressed in (1) of the present invention and a start of the condensation step expressed in (2) of the present invention. At that time, it is suitable that this time from the end of the coating step to the start of the condensation step is about 10 seconds to 120 seconds.

What is necessary for the condensation step in the present invention is that there is time necessary for liquid droplet formation by the condensation to be performed. It is suitable that it is one second to 300 seconds from an aspect of productivity, and further, that it is about 10 seconds to 180 seconds.

Although relative humidity is important for the condensation step in the present invention, it is suitable that ambient temperature is 20° C. or higher and 80° C. or lower.

Subsequently, the drying step of drying a cylindrical supporting member after the condensation step expressed in (3) of the present invention will be described.

The drying step of the present invention which dries the cylindrical supporting member can form liquid droplets, occurring on a surface in the condensation step expressed in (2) in the present invention, as depressed portions in the photosensitive member surface. In order to form highly uniform depressed portions, since prompt drying is important, it is suitable that baking is performed.

As for a dry method in the drying step of the present invention which dries a cylindrical supporting member, for example, baking and air blast dry vacuum drying are cited, and methods of these available methods being combined can be used. In particular, it is suitable that it is the baking and air blast drying from an aspect of productivity. In addition, in order to dry a cylindrical supporting member surface promptly, it is suitable that an inside of a drying oven, a dryer, or a drying chamber is set at desired temperature before the drying step. It is suitable that drying temperature in the drying step is 100° C. or higher and 150° C. or lower. What is necessary for drying step time for drying is that there is the time when the solvent in the coating liquid coated on the cylindrical supporting member, and the water drops formed in the condensation step are removed. It is suitable that the drying step time is 20 minutes or more and 120 minutes or less, and further, it is suitable that it is 40 minutes or more and 100 minutes or less.

Figure 1B:
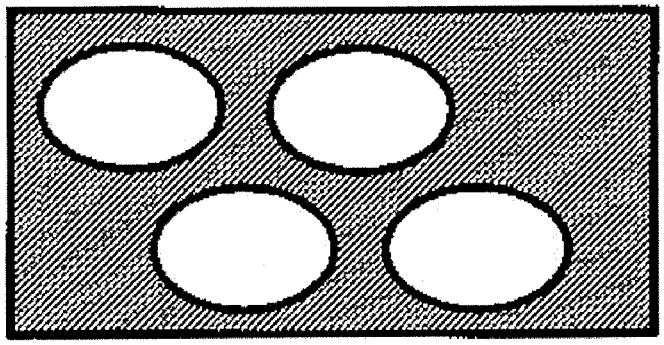
FIG. 1B illustrates one form in surface observation of a depressed portion of the present invention.
Figure 1C:
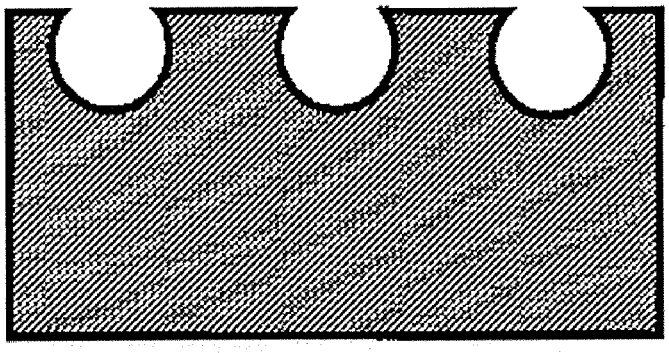
FIG. 1C illustrates one form in surface observation of a depressed portion of the present invention.
Figure 1D:
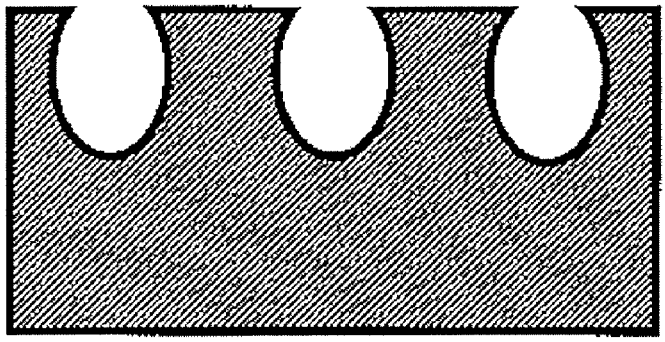
FIG. 1D illustrates one form in surface observation of a depressed portion of the present invention.
Figure 1E:
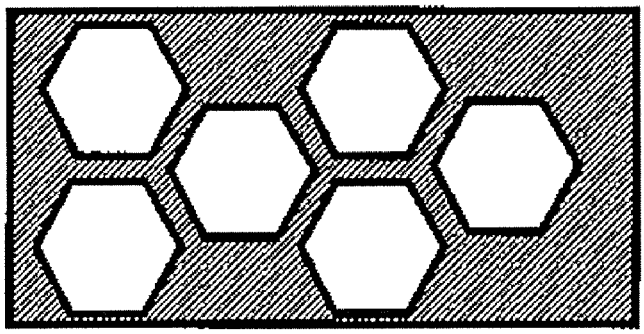
FIG. 1E illustrates one form in surface observation of a depressed portion of the present invention.
Figure 1F:
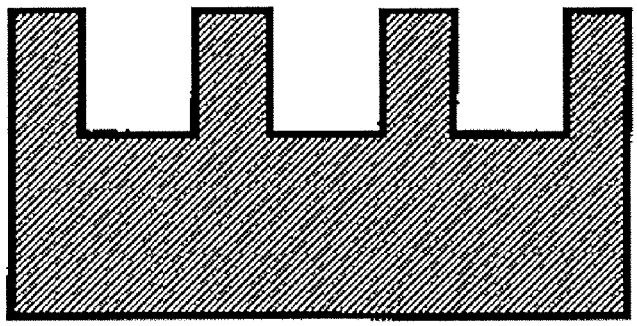
FIG. 1F illustrates one form in surface observation of a depressed portion of the present invention.
Figure 1G:
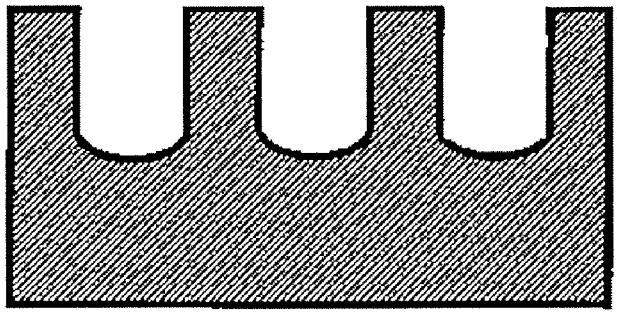
FIG. 1G illustrates one form in surface observation of a depressed portion of the present invention.

Depressed portions which are independent respectively are formed in the photosensitive member surface produced by the above-described production method. The depressed portions which are independent respectively mean a state that the individual depressed portion is clearly distinguished from other depressed portions among a plurality of depressed portions. Since the production method in the present invention forms depressed portions from liquid droplets formed by an action of water using a solvent and a binder resin with low affinity to water, each depressed portion is clearly distinguishable from other depressed portions. Since each form of the depressed portions formed in an electrophotographic photosensitive member surface produced by the production method of the present invention is formed by the cohesion of water, it is a highly uniform depressed portion. Since the production method in the present invention is a production method of passing through the step of removing liquid droplets, or liquid droplets in a state the liquid droplets fully growing, as for the depressed portions in the electrophotographic photosensitive member surface, for example, the depressed portions in a liquid droplet shape or a honeycomb shape (hexagonal shape) is formed. The liquid droplet-shaped depressed portion is a depressed portion observed to be, for example, circular or elliptical according to observation of the photosensitive member surface, and, according to observation of a photosensitive member section, it is, for example, a depressed portion observed to be partially circular or partially elliptical. Specific example of the liquid droplet-shaped depressed portion, depressed portions illustrated in FIGS. 1A and 1B (observation of the photosensitive member surfaces), and FIGS. 1C and 1D (observation of the photosensitive member sections) are cited. In addition, the honeycomb-shaped (hexagonal) depressed portion is, for example, a depressed portion formed by liquid droplets being close-packed in an electrophotographic photosensitive member surface. Specifically, according to the observation of the photosensitive member surface, for example, the depressed portion is circular, hexagonal, or a hexagon with round corners, and according to the observation of the photosensitive member section, for example, it shows a depressed portion to be partially circular or prismatic. Specific example of the honeycomb-shaped (hexagonal) depressed portion, depressed portions illustrated in FIG. 1E (observation of a photosensitive member surface), and FIGS. 1F and 1G (observation of a photosensitive member section) are cited. In addition, in FIGS. 1A to 1G, hatched portions show area parts in which the depressed portions are not formed.

As a depressed portion in a surface of an electrophotographic photosensitive member produced by the production method in the present invention, a depressed portion with 0.1 pm or more and 40 μm or less of major axis size (longest distance in a surface aperture section of the depressed portion) of an individual depressed portion can be produced. In order to form highly uniform depressed portions, it is suitable to be such manufacturing conditions that the major axis size of a depressed portion becomes 0.5 μm or more and 20 μm or less.

In addition, as a depressed portion in a surface of an electrophotographic photosensitive member produced by the production method in the present invention, a depressed portion with 0.1 μm or more and 40 μm or less of depth (longest distance between a surface aperture section and a bottom section of the depressed portion) of an individual depressed portion can be produced. In order to form highly uniform depressed portions, it is suitable to be such manufacturing conditions that the depth of a depressed portion becomes 0.5 μm or more and 20 μm or less.

The above-described major axis size depth of the depressed portion or the number of the depressed portions per unit area in the surface of the electrophotographic photosensitive member produced by the production method in the present invention is controllable by adjusting the manufacturing conditions within limits expressed in the production method in the present invention. The major axis size or depth of a depressed portion is controllable by, for example, a kind of solvent in a surface layer coating liquid described in the present invention, solvent content, relative humidity in the condensation step described in the present invention, holding time in the condensation step, and drying temperature.

Next, the construction of the electrophotographic photosensitive member of the present invention will be described.

As illustrated in FIGS. 2A to 2E, the electrophotographic photosensitive member of the present invention is an electrophotographic photosensitive member which has an intermediate layer 103 and a photosensitive layer 104 on a cylindrical supporting member 101 in this order. (Refer to FIG. 2A)

According to necessity, it can be also performed to provide a conductive layer 102 in which conductive particles are dispersed in resin and volume resistivity is made small between the cylindrical supporting member 101 and intermediate layer 103, to thicken film thickness of the conductive layer 102, and to make it as a layer which covers a defect of a surface of a conductive cylindrical supporting member 101 or a non-conductive cylindrical supporting member 101 (for example, a resin cylindrical supporting member). (Refer to FIG. 2B)

The photosensitive layer may be a monolayer type photosensitive layer 104 which contains a charge transport material and a charge generation material in the same layer (refer to FIG. 2A), or may be a lamination type (function separation type) photosensitive layer separated into a charge generation layer 1041 containing a charge generation material, and a charge transport layer 1042 containing a charge transport material. From an aspect of electrophotography characteristics, the lamination type photosensitive layer is suitable. In the case of the monolayer type photosensitive layer, a top layer of the present invention is the photosensitive layer 104. In addition, in the lamination type photosensitive layer, there are a normal layer type photosensitive layer (refer to FIG. 2C) laminated in order of the charge generation layer 1041 and the charge transport layer 1042 from a cylindrical supporting member 101 side, and an inverse layer type photosensitive layer (refer to FIG. 2D) laminated in order of the charge transport layer 1042 and the charge generation layer 1041 from the cylindrical supporting member 101 side. From an aspect of electrophotography characteristics, the normal layer type photosensitive layer is suitable. Among the lamination type photosensitive member, in the case of the normal layer type photosensitive layer, a top layer of the present invention is a carrier transport layer, and, in the case of the inverse layer type photosensitive layer, a top layer of the present invention is a charge generation layer.

Figure 2A:
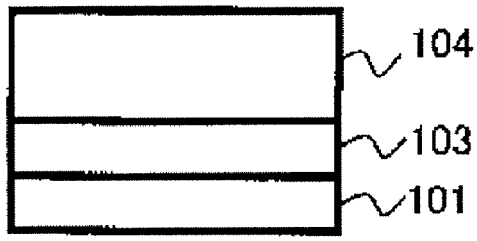
FIG. 2A illustrates an example of layer structure of an electrophotographic photosensitive member of the present invention.
Figure 2B:
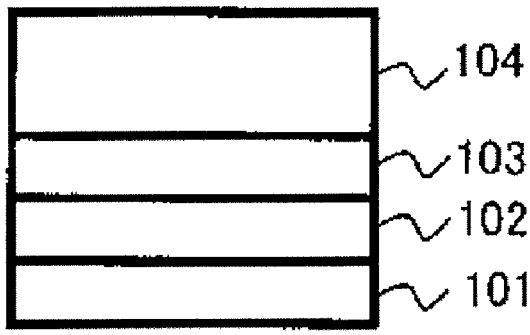
FIG. 2B illustrates an example of layer structure of the electrophotographic photosensitive member of the present invention.
Figure 2C:
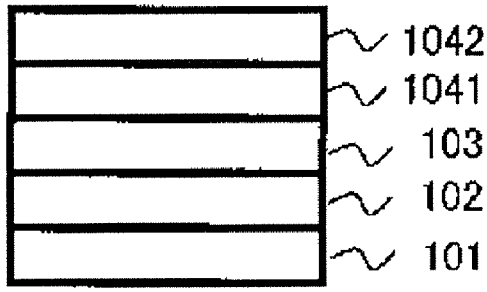
FIG. 2C illustrates an example of layer structure of the electrophotographic photosensitive member of the present invention.
Figure 2D:
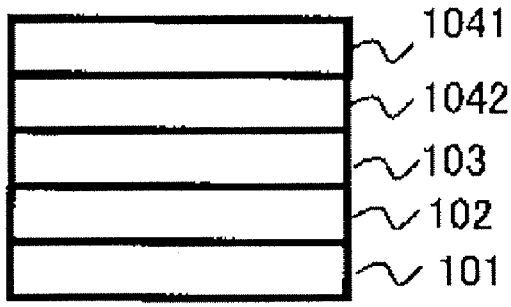
FIG. 2D illustrates an example of layer structure of the electrophotographic photosensitive member of the present invention.
Figure 2E:
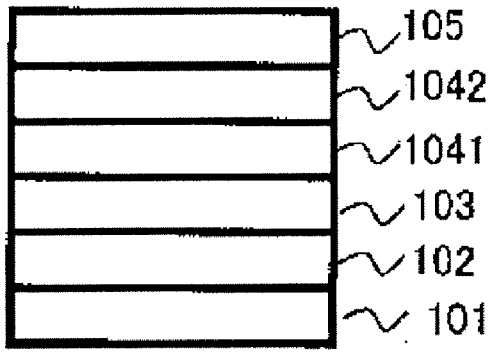
FIG. 2E illustrates an example of layer structure of the electrophotographic photosensitive member of the present invention.

In addition, a protective layer 105 may be provided on the photosensitive layer 104 (charge generation layer 1041, and charge transport layer 1042) (refer to FIG. 2E). In the case of having the protective layer 105, a top layer of the present invention is the protective layer 105.

As the cylindrical supporting member 101, what has electroconductivity (conductive cylindrical supporting member) is suitable, and, for example, it can be performed to use a cylindrical supporting member made of metal such as aluminum, an aluminum alloy, or stainless steel. In the case of the aluminum or aluminum alloy, it can be performed to use an ED pipe, an EI pipe, or what they are given machining, electrolytic combined polishing (electrolysis by electrodes and an electrolytic solution which have an electrolytic action, and polishing by a grindstone which has a polishing action), wet or one dry honing process. In addition, it can be also performed to use the above-mentioned metal cylindrical supporting member which has a layer which is made by film-formation of aluminum, an aluminum alloy, or an indium oxide tin protoxide alloy by vacuum evaporation, and the resin cylindrical supporting member (polyethylene terephthalate, polybutylene terephthalate, phenolic resin, polypropylene, or polystyrene resin). In addition, it can be also performed to use a cylindrical supporting member that conductive particles such as carbon black, tin oxide particles, titanium oxide particles, or silver particles are impregnated in a resin or paper, or a plastic which has a conductive binder resin.

In the case that a surface of a supporting member is a layer provided in order to give electroconductivity, as to volume resistivity of the conductive cylindrical supporting member, it is suitable that the volume resistivity of the layer is $1\times10^{10}$ Ω·cm or less, and in particular, it is more suitable it is $1\times10^{6}$ Ω·cm or less.

On the conductive cylindrical supporting member, it may be performed to provide a conductive layer for covering a scratch of a conductive cylindrical supporting member surface. This is a layer formed by coating a coating liquid that conductive powder is dispersed in a suitable binder resin.

The followings are cited as such conductive powder. Carbon black, acetylene black; metal powder such as aluminum, nickel, iron, nichrome, copper, zinc, or silver; and metal oxide powder such as conductive tin oxide, and ITO.

In addition, as the binder resin used at the same time, the following thermoplastic resins, thermosetting resins, or photoresists are cited. Polystyrene, a styrene acrylonitrile copolymer, a styrene butadiene copolymer, a styrene-maleic anhydride copolymer, polyester, polyvinyl chloride, a vinyl chloride-vinyl acetate copolymer, polyvinyl acetate, polyvinylidene chloride, a polyarylate resin, a phenoxy resin, polycarbonate, an acetyl cellulose resin, an ethyl cellulose resin, polyvinyl butyral, polyvinyl formal, polyvinyl toluene, poly-N-vinylcarbazole, an acrylic resin, a silicone resin, an epoxy resin, a melamine resin, an urethane resin, a phenolic resin, and an alkyd resin.

The conductive layer can be formed by dispersing or dissolving the above-mentioned conductive powder and binder resin in ethers such as tetrahydrofuran, and ethyleneglycol dimethyl ether; alcohol solvents such as methanol; ketones such as methyl ethyl ketone; and aromatic hydrocarbon solvents such as methylbenzene, and coating these. A suitable average film thickness of the conductive layer is 5 μm or more and 40 μm or less, and a more suitable one is 10 μm or more and 30 μm or less.

An intermediate layer which has a barrier function is provided on the conductive cylindrical supporting member or conductive layer.

The intermediate layer can be formed by hardening a thermosetting resin after coating it to form a resin layer, or by coating a coating liquid for an intermediate layer, containing a binder resin, on the conductive layer, and drying it.

As the binder resin of the intermediate layer, the followings are cited. Water-soluble resins such as polyvinyl alcohol, polyvinyl methyl ether, polyacrylic acids, methylcellulose, ethyl cellulose, polyglutamic acid, and casein; and a polyamide resin, a polyimide resin, a polyamide imide resin, a polyamide acid resin, a melamine resin, an epoxy resin, a polyurethane resin, and a polyglutamic acid ester resin. In order to make electric barrier property expressed effectively, and in view of coating property, adhesion, solvent resistance, and resistivity, the thermoplastic resin is suitable as the binder resin of the intermediate layer. Specifically, the thermoplastic polyamide resin is suitable. As the polyamide resin, low-crystalline or amorphous copolyamide which can be coated in a solution state is suitable. As for a film thickness of the intermediate layer, it is suitable to be 0.1 μm or more and 2.0 μm or less.

In addition, in order to prevent a flow of electric charges (carriers) from being stopped in the intermediate layer, it may be performed to disperse semiconductive particles in the intermediate layer, or to make an electron transport substance (electron receptive substance such as an acceptor) contained.

A photosensitive layer is provided on the intermediate layer.

The followings are cited as the charge generation material used for the electrophotographic photosensitive member of the present invention. Azo pigments such as monoazo, disazo, and trisazo; phthalocyanine pigments such as metal phthalocyanine and nonmetal phthalocyanine; indigo pigments such as indigo and thioindigo; perylene pigments such as perylene acid anhydride, and perylene acid imide; polycyclic quinone pigments such as anthraquinone, and pyrene quinone; a squalirium dye, pyrylium salt and thiapyrylium salt, and a triphenylmethane dye; inorganic matters such as selenium, selenium tellurium, and amorphous silicon; and a quinacridone pigment, an azulenium salt pigment, a cyanine dye, a xanthene dye, quinonimine dye, a styryl pigment. These charge generation materials may be used singly, or two or more kinds of them may be used. Also among these, since the metal phthalocyanine such as oxy titanium phthalocyanine, hydroxygallium phthalocyanine, and chlorogallium phthalocyanine has high sensitivity in particular, it is suitable.

When the photosensitive layer is a lamination type photosensitive layer, the followings are cited as the binder resin used for a charge generation layer. A polycarbonate resin, a polyester resin, a polyarylate resin, a butyral resin, a polystyrene resin, a polyvinyl acetal resin, a diallyl phthalate resin, an acrylic resin, a methacrylic resin, a vinyl acetate resin, a phenolic resin, a silicone resin, a polysulfone resin, a styrene-butadiene copolymer resin, an alkyd resin, an epoxy resin, a urea resin, and a polyvinyl chloride vinyl acetate copolymer resin. In particular, the butyral resin is suitable. As for these, one kind, or two or more kinds can be used as an independent one, mixed ones, or a copolymer.

The charge generation layer can be formed by coating and drying a coating liquid for a charge generation layer obtained by dispersing a charge generation material with a binder resin and a solvent. As the distribution method, a method using a homogenizer, an ultrasonic wave, a ball mill, a sand mill, an attritor, or a roll mill is cited. It is suitable that a ratio of the charge generation material to the binder resin is in a range of 10:1 to 1:10 (mass ratio), and in particular, it is more suitable that it is in a range of 3:1 to 1:1 (mass ratio).

A solvent used for the coating liquid for a charge generation layer is selected from solubility and dispersion stability of the binder resin and charge generation material. As the organic solvent, an alcohol solvent, a sulfoxide solvent, a ketone solvent, an ether solvent, an ester solvent, or an aromatic hydrocarbon solvent is cited.

As for an average film thickness of the charge generation layer, it is suitable to be 5 μm or less, and in particular, it is more suitable to be 0.1 μm or more and 2 μm or less.

In addition, it can be also performed to add various sensitizers, an anti-oxidant, a UV absorber, and/or a plasticizer to the charge generation layer if needed. In addition, in order to prevent a flow of electric charges (carriers) from being stopped in the charge generation layer, it may be performed to make an electron transport substance (electron receptive substance such as an acceptor) contained.

As the charge transport material used for the electrophotographic photosensitive member of the present invention, a triarylamine compound, a hydrazone compound, a styryl compound, a stilbene compound, a pyrazoline compound, an oxazol compound, a thiazole compound, or a triallylmethane compound is cited. These charge transport materials may be used singly, or two or more kinds of them may be used.

The charge transport layer can be formed by coating and drying a coating liquid for a charge transport layer obtained by dissolving a charge transport material and a binder resin in a solvent. A suitable ratio of the charge transport material to the binder resin is in a range of 2:1 to 1:2 (mass ratio).

When a photosensitive layer is a monolayer type photosensitive layer and a surface layer, the monolayer type photosensitive layer can produce the photosensitive member which has an effect of the present invention by coating a surface layer coating liquid for a monolayer type photosensitive layer which contains the above-mentioned charge generation material, the above-mentioned charge transport material, the binder resin described in the present invention, and an aromatic organic solvent whose dipole moment found by dipole moment calculation by the structure optimized-calculation using semiempirical molecular orbital calculation is 1.0 or less at the content of 50% by mass or more and 80% by mass or less based on the total mass of solvents in the coating liquid for a surface layer, and passing through the production process of the present invention.

When a photosensitive layer is a lamination type photosensitive layer and a charge transport layer is a surface layer, it can be performed to produce the photosensitive member, which has an effect of the present invention, by coating a surface layer coating liquid which contains the above-mentioned charge transport material, the binder resin described in the present invention, and an aromatic organic solvent whose dipole moment is 1.0 or less at a content of 50% by mass or more and 80% by mass or less based on the total mass of solvents in the coating liquid for a surface layer, and passing through the production process of the present invention.

As the solvent used for the coating liquid for a surface layer, it is necessary for production of the photosensitive member, which has an effect of the present invention, by passing through the production process of the present invention to contain an aromatic organic solvent whose dipole moment is 1.0 or less at 50% by mass or more and 80% by mass or less based on the total mass of solvents in the coating liquid for a surface layer. Nevertheless, it can be also performed to mixedly use other solvents for such a purpose of improvement of coating property. As the other solvents, solvents whose dipole moment is larger than 1.0 and smaller than 2.8, or whose dipole moment is 1.0 or less and which do not include an aromatic organic solvent are cited. When showing the above-mentioned other solvents specifically, the solvents listed in Table 3 are cited. (A solvent C denotes a solvent whose dipole moment is larger than 1.0 and smaller than 2.8, or whose dipole moment is 1.0 or less and which is not an aromatic organic solvent. The dipole moment shows dipole moment found by the dipole moment calculation by the structure optimized-calculation using the semiempirical molecular orbital calculation of a target solvent.)

TABLE 3

| | Name | Dipole moment [Debye] |
|---|---|---|
| Solvent C | Acetone | 2.77 |
| | Butane-2-one (trivial name: methyl ethyl ketone) | 2.79 |
| | Methyl acetate | 1.83 |
| | Ethyl acetate | 1.95 |
| | Oxolane (trivial name: tetrahydrofuran) | 1.66 |
| | 1,4-dioxane | 0.01 |
| | Dimethoxymethane | 2.42 |

Although all can be adapted for the production method of the present invention so long as they are solvents shown in the solvent C in Table 3, among them, it is suitable that it is oxolane or dimethoxymethane. These organic solvents can be contained independently, or can be contained with two or more kinds of them being mixed.

As for an average film thickness of the charge transport layer, it is suitable to be 5 μm or more and 40 μm or less, and in particular, it is more suitable to be 10 μm or more and 30 μm or less.

In addition, it can be also performed to add, for example, an anti-oxidant, a UV absorber, and/or a plasticizer to the charge transport layer if needed.

In addition, a protective layer for a purpose of protecting the photosensitive layer may be provided on the photosensitive layer. The protective layer can be formed by coating and drying a coating liquid for a protective layer (coating liquid for surface layer formation) obtained by dissolving the binder resin in the present invention, mentioned above, in the solvent in the present invention.

As for an average film thickness of the protective layer, it is suitable to be 0.5 μm or more and 10 μm or less, and in particular, it is more suitable to be 1 μm or more and 5 μm or less.

EXAMPLES

The present invention will be described below in further detail with citing specific examples. Nevertheless, the present invention is not limited to these. In addition, in the embodiments, a "part(s)" means a "part(s) by mass", and "%" means "% by mass."

Example 1

An aluminum cylinder (Japanese Industrial Standards-A3003, ED pipe of an aluminum alloy made by Showa Aluminum Co., Ltd.) in 260.5-mm of length and 30-mm of diameter which was obtained by performing hot extrusion under an environment of 23° C. and 60% was used as a conductive cylindrical supporting member.

A dispersion liquid was prepared by dispersing 6.6 parts of $TiO_2$ particles (powder resistivity: 80 Ω·cm, and a coverage (a mass rate) of $SnO_2$ is 50%) which covered oxygen deficiency type $SnO_2$ as conductive particles, 5.5 parts of phenolic resin as a binder resin (trade name: Plyofen J325, made by Dainippon Ink & Chemicals, Inc., 60% of resin solid content), and 5.9 parts of methoxypropanol as a solvent with a sand mill, using glass beads at a diameter of 1 mm, for 3 hours.

A coating liquid for conductive layers was prepared by adding 0.5 parts of silicone resin particles (trade name: Tospearl 120, made by GE Toshiba Silicones Co., Ltd., average particle diameter of 2 μm) as a surface roughing additive, and 0.001 parts of silicone oil (trade name: SH28PA, made by TORAY DOW CORNING SILICONE Co., Ltd.) as a leveling agent, to this dispersion liquid, and stirring them.

A conductive layer at an average film thickness of 15 μm was formed in a position of 130 mm from an upper edge of the conductive cylindrical supporting member by dip coating this coating liquid for a conductive layer on the conductive cylindrical supporting member, and drying and heat-hardening it for 30 minutes at the temperature of 140° C.

Furthermore, on the conductive layer, an intermediate layer whose average film thickness in a 130-mm position from an upper edge of the cylindrical supporting member is 0.5 μm is formed by dip-coating a coating liquid for an intermediate layer which was obtained by dissolving 4 parts of N-methoxy methylation nylon (trade name: Tresin EF-30T, made by Teikoku Chemical K.K.), and 2 parts of copolymerization nylon resin (Amilan CM8000, made by Toray Industries, Inc.) in a mixed solvent of 65 parts of methanol and 30 parts of n-butanol, and drying it for 10 minutes at the temperature of 100° C.

Next, a coating liquid for a charge generation layer was prepared by dispersing 10 parts of hydroxygallium phthalocyanine having a crystal form which has strong peaks at Bragg angles (2θ±0.2°) of 7.5°, 9.9°, 16.3°, 18.6°, 25.1°, and 28.3° in CuKα characteristic X-ray diffraction, 5 parts of polyvinyl butyral (trade name: S-LEC BX-1, made by Sekisui Chemical Co., Ltd.), and 250 parts of cyclohexanone with a sand mill, using glass beads at a diameter of 1 mm, for one hour, and next applying 250 parts of ethyl acetate.

A charge generation layer at an average film thickness of 0.16 μm was formed in a position of 130 mm from an upper edge of the cylindrical supporting member by dip coating this coating liquid for a charge generation layer on the intermediate layer, and drying it for 10 minutes at the temperature of 100° C.

Next, a coating liquid for a surface layer containing a charge transport material was prepared by dissolving 10 parts of charge transport material which has structure expressed in the following formula (CTM-1):

(CTM-1)

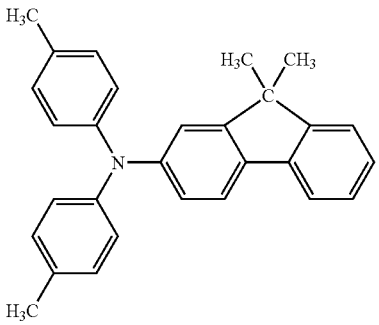

10 parts of polycarbonate resin (Iupilon Z-400, made by Mitsubishi Engineering-Plastics Corp.) [viscosity-average molecular weight (MV) 40,000], which was constructed of a repetition unit expressed in the following formula (P-1), as a binder resin:

(P-1)

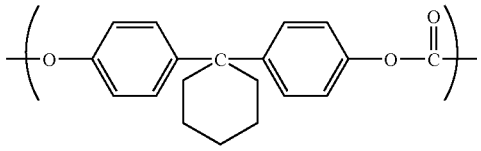

in a mixed solvent of 65 parts of chlorobenzene, whose dipole moment was 1.0 or less, as an aromatic organic solvent (solvent A in Table 4), and 35 parts of dimethoxymethane as other solvents (solvent C in Table 4). The step of preparing the coating liquid for a surface layer was performed in a state that relative humidity was 45% and ambient temperature was 25° C.

A step of dip-coating the coating liquid for a surface layer prepared as described above on the charge generation layer to coat the coating liquid for a surface layer on the cylindrical supporting member was performed. The step of coating the coating liquid for a surface layer was performed in a state that relative humidity was 45% and ambient temperature was 25° C.

After 60 seconds from an end of the coating step, the cylindrical supporting member on which the coating liquid for a surface layer was coated was held for 120 seconds inside an apparatus for a condensation step which was made beforehand into a state that relative humidity was 90% and ambient temperature was 60° C. inside the apparatus.

After 60 seconds from an end of the condensation step, the cylindrical supporting member was put into a blower dryer, inside which was heated at 120° C. beforehand, for the drying step to be performed for 60 minutes, and a charge transport layer at an average film thickness of 15 μm was formed in a position of 130 mm from an upper edge of the cylindrical supporting member.

In this way, the electrophotographic photosensitive member that the charge transport layer was a surface layer produced.

In addition, a measuring method of the viscosity-average molecular weight (MV) is as follows.

First, 0.5 g of sample was dissolved in 100 ml of methylene chloride, and specific viscosity at 25° C. was measured using an improved Ubbelohde type viscometer. Next, limiting viscosity was found from this specific viscosity, and the viscosity-average molecular weight (MV) was calculated with Mark-Houwink viscosity equation. As the viscosity-average molecular weight (MV), a polystyrene equivalent measured with a GPC (gel permeation chromatography) was used.

Figure 3:
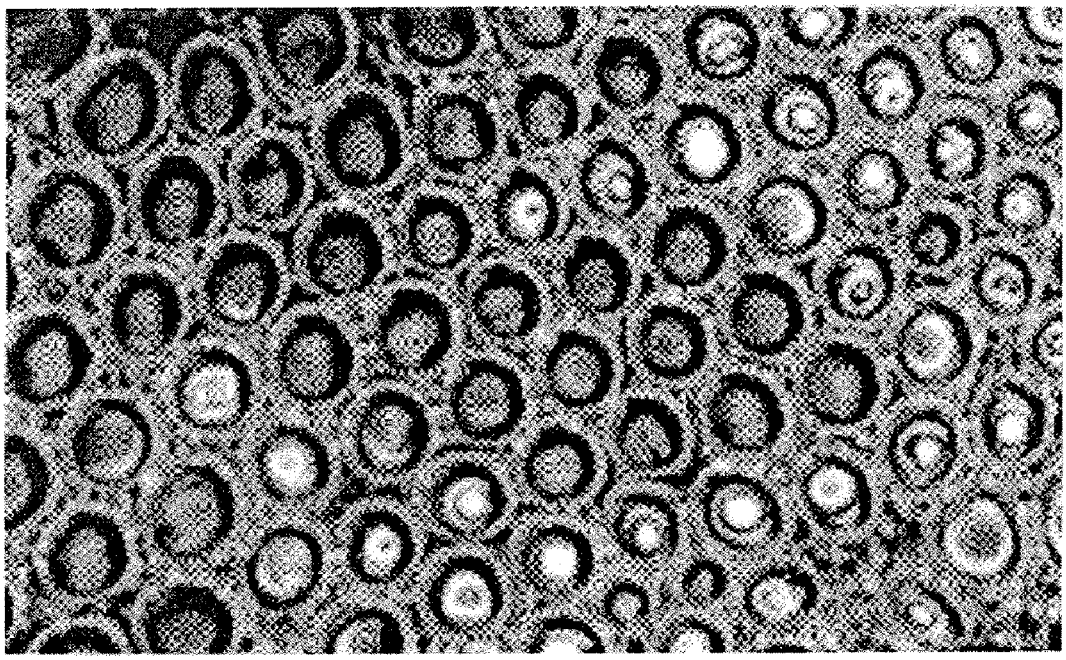
FIG. 3 illustrates an image of the depressed portion on the surface of the photosensitive member, produced by Example 1, by a laser microscope.

For the produced electrophotographic photosensitive member, measurement*1 of a depressed portion of a photosensitive member surface and uniformity*2 of the depressed portion were evaluated. The result is shown in Table 4. In addition, an image of the photosensitive member surface measured by the following evaluation method is shown in FIG. 3.

*1: Measurement of depressed portion of photosensitive member surface

*2: Evaluation method of uniformity of depressed portion

The surface of the produced electrophotographic photosensitive member was observed using super-depth shape measuring microscope VK-9500 (made by KEYENCE CORP.). The electrophotographic photosensitive member which was a measuring object was placed on a holding base worked so as to be able to fix the cylindrical supporting member, and performed surface observation of a position apart 140 mm from an upper edge of the electrophotographic photosensitive member. At that time, with letting objective lens magnification be 50 times, and letting 100 μm square of the photosensitive member surface be visual field observation, measurement of the depressed portion was performed.

The depressed portion observed in the measurement view was analyzed using an analyzing program. The major axis size of a surface part (aperture part) of the depressed portion in the measurement view was measured, and its average value was calculated. (The major axis size in Table 4 shows the average major axis size calculated in this way.) In addition, the distance between a deepest part and an aperture part of the depressed portion in the measurement view was measured, and its average value was calculated. (The depth in Table 4 shows the average value of the distance between the deepest part and aperture surface of the depressed portion which were calculated in this way.)

With the same method as that in the measurement of the depressed portion of the photosensitive member surface, with letting 100 μm square of photosensitive member surface be visual field observation, measurement was performed. The depressed portion observed in the measurement view was analyzed using an analyzing program. The major axis size of a surface part (aperture part) of the depressed portion in the measurement view was measured, and its average value (average major axis size) was calculated. The number of the depressed portions which have 0.8 times or more of major axis size, or 1.2 times or less of major axis size to the above-mentioned average major axis size was measured among the depressed portions in the measurement view. The uniformity of the depressed portions was found from a rate of the number of the depressed portions which have 0.8 time or more of major axis size, or 1.2 times or less of major axis size to the average major axis size per 100 μm square to the number of total depressed portions per 100 μm square. (The uniformity in Table 4 shows ((number of depressed portions which have 0.8 time or more of major axis size, or 1.2 times or less of major axis size to average major axis size per 100 μm square)/(number of total depressed portions per 100 μm square).)

The result mentioned above is shown in Table 4.

Examples 2 and 3

Electrophotographic photosensitive members were produced in the same manner as in Example 1 except that the relative humidity and ambient temperature in the condensation step were changed to the conditions shown in Table 4, and were evaluated. The results are shown in Table 4.

Example 4

Electrophotographic photosensitive member was produced in the same manner as in Example 1 except that the relative humidity and ambient temperature in the condensation step are changed to the conditions shown in Table 4, and the cylindrical supporting member holding time was changed to 180 seconds, and was evaluated. The result is shown in Table 4.

Example 5

Electrophotographic photosensitive member was produced in the same manner as in Example 1 except that the relative humidity and ambient temperature in the condensation step were changed to the conditions shown in Table 4, and the cylindrical supporting member holding time was changed to 20 seconds, and was evaluated. The result is shown in Table 4.

Example 6

Electrophotographic photosensitive member was produced in the same manner as in Example 1 except that the binder resin in a coating liquid for a surface layer was changed to a polyarylate resin (weight-average molecular weight (Mw): 120,000), which has a repetition structural part shown in the following formula (P-2), and the solvent in the coating liquid for a surface layer was changed to 50 parts of chlorobenzene, 10 parts of oxolane, and 40 parts of dimethoxymethane, and was evaluated.

(P-2)

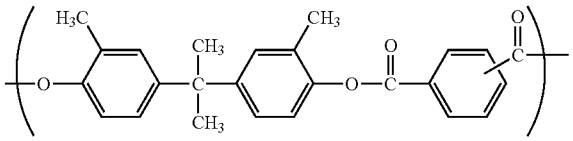

The result is shown in Table 4.

In addition, a mole ratio (terephthalic acid structure:isophthalic acid structure) of the terephthalic acid structure and isophthalic acid structure in the above-mentioned polyarylate resin is 50:50.

In the present invention, weight-average molecular weight of a resin is measured according to a conventional method as follows.

That is, after a measuring object resin had been put in tetrahydrofuran and left for several hours, the measuring object resin and tetrahydrofuran had been mixed well with having been shaken (mixed until a coalescence of the measuring object resin disappeared), and they had been further left at rest for 12 hours or more.

Then, what passed a sampling filter, My-Shori-Disk H-25-5 made by TOSOH CORP. was made into a sample for a GPC (gel permeation chromatography).

Next, a column was stabilized in a 40° C. heat chamber, tetrahydrofuran was flowed in a flow speed of 1 ml/min as a solvent in the column in this temperature, 10 μl of sample for a GPC was injected, and the weight-average molecular weight of the measuring object resin was measured. TSKgel Super HM-M made by TOSOH CORP. was used for the column.

In the measurement of the weight-average molecular weight of the measuring object resin, a molecular weight distribution which the measuring object resin had was calculated from relationship between the logarithmic value of a calibration curve and the number of counts which were created with several kinds of monodisperse polystyrene standard samples. Ten pieces of Aldrich Corporation's monodisperse polystyrene with molecular weight of 3,500, 12,000, 40,000, 75,000, 98,000, 120,000, 240,000, 500,000, 800,000, and 1,800,000 were used for standard polystyrene samples for calibration curve creation. An RI (refractive index) detecting element was used for a detecting element.

Example 7

Electrophotographic photosensitive member was produced in the same manner as in Example 1 except that the binder resin in a coating liquid for a surface layer was changed into a polyarylate resin (weight-average molecular weight (Mw): 110,000), which has a repetition structural part shown in the following formula (P-3), and the solvent in the coating liquid for a surface layer was changed to 50 parts of chlorobenzene, 30 parts of oxolane, and 20 parts of dimethoxymethane, and was evaluated.

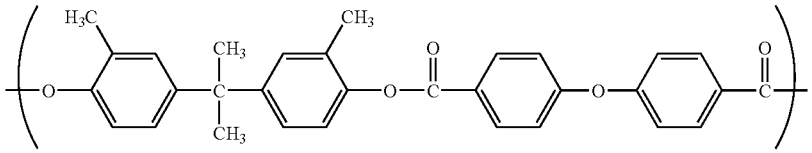

(P-3)

The result is shown in Table 4.

Example 8

Electrophotographic photosensitive member was produced in the same manner as in Example 1 except that the solvent in a coating liquid for a surface layer was changed to 80 parts of chlorobenzene and 20 parts of dimethoxymethane, and the cylindrical supporting member holding time in the condensation step was changed to 40 seconds, and was evaluated. The result is shown in Table 4.

Example 9

Electrophotographic photosensitive member was produced in the same manner as in Example 1 except that the solvent in a coating liquid for a surface layer was changed from chlorobenzene to 1,3-dimethylbenzene, and was evaluated. The result is shown in Table 4.

Example 10

Electrophotographic photosensitive member was produced in the same manner as in Example 1 except that the solvent in a coating liquid for a surface layer was changed from chlorobenzene to 1,2-dimethylbenzene, and was evaluated. The result is shown in Table 4.

Example 11

Electrophotographic photosensitive member was produced in the same manner as in Example 1 except that the solvent in a coating liquid for a surface layer was changed to 60 parts of 1,3,5-trimethylbenzene and 40 parts of oxolane, and the cylindrical supporting member holding time in the condensation step was changed to 200 seconds, and was evaluated. The result is shown in Table 4.

Examples 12 and 13

Electrophotographic photosensitive members were produced in the same manner as in Example 1 except that the temperature of a coating liquid for a surface layer was cooled in 18° C., the relative humidity and ambient temperature in the condensation step were changed to the conditions shown in Table 4, and the cylindrical supporting member holding time was changed to 45 seconds, and were evaluated. The results are shown in Table 4.

Comparative Examples 1 and 2

Electrophotographic photosensitive members were produced in the same manner as in Example 1 except that the solvent in a coating liquid for a surface layer was changed to 100 parts of chlorobenzene, the relative humidity and ambient temperature in the condensation step were changed to the conditions shown in Table 4, and were evaluated. The results are shown in Table 4.

Comparative Example 3

Electrophotographic photosensitive member was produced in the same manner as in Example 3 except that the solvent in a coating liquid for a surface layer was changed to 30 parts of chlorobenzene, 50 parts of oxolane and 20 parts of dimethoxymethane, and was evaluated. The result is shown in Table 4.

Comparative Example 4

Electrophotographic photosensitive member was produced in the same manner as in Example 3 except that the solvent in a coating liquid for a surface layer was changed to 100 parts of oxolane, and was evaluated. The result is shown in Table 4.

Comparative Example 5

Electrophotographic photosensitive member was produced in the same manner as in Example 3 except that the solvent in a coating liquid for a surface layer was changed to 100 parts of dichloromethane (dipole moment: 1.36, obtained by dipole moment calculation by structure optimized-calculation using semiempirical molecular orbital calculation, boiling point: 40° C.), and was evaluated. The result is shown in Table 4.

Comparative Example 6

Electrophotographic photosensitive member was produced in the same manner as in Example 1 except that the condensation step was not performed, but the drying step promptly after coating a surface layer was performed, In consequence, formation of a depressed portion was not observed in the photosensitive member surface.

Comparative Example 7

Electrophotographic photosensitive member was produced in the same manner as in Example 1 except that the relative humidity and ambient temperature in the condensation step was changed to 40% of relative humidity and 20° C. of ambient temperature. In consequence, formation of a depressed portion was not observed in the photosensitive member surface.

In addition, when Examples 1 to 13 of the present invention are compared with Comparative Examples 6 to 7, it turns out that an electrophotographic photosensitive member which has highly uniform depressed portions on the electrophotographic photosensitive member can be produced by providing the condensation step in the present invention.

TABLE 4

| | Solvent A [% by mass] | Solvent B [% by mass] | Solvent C [% by mass] | Condensation step relative humidity [%] | Condensation step ambient temperature [° C.] | Surface depressed portion Major axis size [μm] | Depth [μm] | Uniformity |
|---|---|---|---|---|---|---|---|---|
| Ex. 1 | Chlorobenzene [65] | — | Dimethoxy methane [35] | 90 | 60 | 4.2 | 6.0 | 0.99 |
| Ex. 2 | Chlorobenzene [65] | — | Dimethoxy methane [35] | 70 | 60 | 6.1 | 3.0 | 0.96 |
| Ex. 3 | Chlorobenzene [65] | — | Dimethoxy methane [35] | 70 | 45 | 1.5 | 2.0 | 0.98 |
| Ex. 4 | Chlorobenzene [65] | — | Dimethoxy methane [35] | 70 | 45 | 6.0 | 5.4 | 0.99 |
| Ex. 5 | Chlorobenzene [65] | — | Dimethoxy methane [35] | 70 | 30 | 0.4 | 0.6 | 0.95 |
| Ex. 6 | Chlorobenzene [50] | — | Oxolane [10] Dimethoxy methane [40] | 70 | 60 | 1.3 | 2.8 | 0.94 |
| Ex. 7 | Chlorobenzene [50] | — | Oxolane [30] Dimethoxy methane [20] | 70 | 60 | 6.8 | 7.2 | 0.99 |
| Ex. 8 | Chlorobenzene [80] | — | Dimethoxy methane [20] | 70 | 60 | 0.8 | 1.2 | 0.97 |
| Ex. 9 | 1,3-dimethylbenzene [65] | — | Dimethoxy methane [35] | 70 | 60 | 3.1 | 2.8 | 0.96 |
| Ex. 10 | 1,2-dimethylbenzene [65] | — | Dimethoxy methane [35] | 70 | 45 | 2.9 | 4.1 | 0.99 |
| Ex. 11 | 1,3,5-Trimethylbenzene [60] | — | Oxolane [40] | 70 | 45 | 8.6 | 4.3 | 0.96 |
| Ex. 12 | Chlorobenzene [65] | — | Dimethoxy methane [35] | 70 | 45 | 2.0 | 1.5 | 0.98 |
| Ex. 13 | Chlorobenzene [65] | — | Dimethoxy methane [35] | 70 | 30 | 1.5 | 1.2 | 0.98 |
| Com. Ex. 1 | Chlorobenzene [100] | — | — | 70 | 60 | 3.0 | 0.1 | 0.72 |
| Com. Ex. 2 | Chlorobenzene [100] | — | — | 70 | 30 | No depression formation | | |
| Com. Ex. 3 | Chlorobenzene [30] | — | Oxolane [50] Dimethoxy methane [20] | 70 | 45 | 0.2 | 0.4 | 0.76 |
| Com. Ex. 4 | — | — | Oxolane [100] | 70 | 45 | 0.3 | 0.5 | 0.74 |
| Com. Ex. 5 | — | — | Dichloromethane [100] | 70 | 45 | 4.6 | 2.7 | 0.79 |
| Com. Ex. 6 | Chlorobenzene [65] | — | Dimethoxy methane [35] | No step | | No depression formation | | |
| Com. Ex. 7 | Chlorobenzene [65] | — | Dimethoxy methane [35] | 40 | 20 | No depression formation | | |

When Examples 1 to 13 of the present invention are compared with Comparative Examples 1 to 5 from the above result, it turns out that an electrophotographic photosensitive member which has highly uniform depressed portions on the electrophotographic photosensitive member can be produced by using the coating liquid for a surface layer which contains the binder resin and the aromatic organic solvent, whose dipole moment found by dipole moment calculation by structure optimized-calculation using semiempirical molecular orbital calculation is 1.0 or less, in the present invention, and in which content of the aromatic organic solvent is 50% by mass or more and 80% by mass or less based on the total mass of solvents in the coating liquid for a surface layer.

Example 14

An aluminum cylinder (Japanese Industrial Standards-A3003, ED pipe of an aluminum alloy made by Showa Aluminum Co., Ltd.) in 260.5 mm of length and 30 mm of diameter which was obtained by performing hot extrusion under an environment of 23° C. and 60% was used as a conductive cylindrical supporting member.

A dispersion liquid was prepared by dispersing 6.6 parts of $TiO_2$ particles (powder resistivity: 80 Ω·cm, and a coverage (a mass rate) of $SnO_2$ is 50%) which covered oxygen deficiency type $SnO_2$ as conductive particles, 5.5 parts of phenolic resin as a binder resin (trade name: Plyofen J-325, made by Dainippon Ink & Chemicals, Inc., 60% of resin solid content), and 5.9 parts of methoxypropanol as a solvent with a sand mill, using glass beads at a diameter of 1 mm, for 3 hours.

A coating liquid for a conductive layer was prepared by adding 0.5 parts of silicone resin particles (trade name: Tospearl 120, made by GE Toshiba Silicones Co., Ltd., average particle diameter of 2 μm) as a surface roughing additive, and 0.001 parts of silicone oil (trade name: SH28PA, made by TORAY DOW CORNING SILICONE Co., Ltd.) as a leveling agent, to this dispersion liquid, and stirring them.

A conductive layer at an average film thickness of 15 μm was formed in a position of 130 mm from an upper edge of the conductive cylindrical supporting member by dip coating this coating liquid for a conductive layer on the conductive cylindrical supporting member, and drying and heat-hardening it for 30 minutes at the temperature of 140° C.

Furthermore, on the conductive layer, an intermediate layer whose average film thickness in a 130-mm position from an upper edge of the cylindrical supporting member is 0.5 μm is formed by dip-coating a coating liquid for an intermediate layer which was obtained by dissolving 4 parts of N-methoxy methylation nylon (trade name: Tresin EF-30T, made by Teikoku Chemical K.K.), and 2 parts of copolymerization nylon resin (Amilan CM8000, made by Toray Industries, Inc.) in a mixed solvent of 65 parts of methanol and 30 parts of n-butanol, and drying it for 10 minutes at the temperature of 100° C.

Next, a coating liquid for a charge generation layer was prepared by dispersing 10 parts of hydroxygallium phthalocyanine having a crystal form which has strong peaks at Bragg angles (2θ±0.2°) of 7.5°, 9.9°, 16.3°, 18.6°, 25.1°, and 28.3° in CuKα characteristic X-ray diffraction, 5 parts of polyvinyl butyral (trade name: S-LEC BX-1, made by Sekisui Chemical Co., Ltd.), and 250 parts of cyclohexanone with a sand mill, using glass beads at a diameter of 1 mm, for one hour, and next applying 250 parts of ethyl acetate.

A charge generation layer at an average film thickness of 0.16 μm was formed in a position of 130 mm from an upper edge of the cylindrical supporting member by dip coating this coating liquid for a charge generation layer on the intermediate layer, and drying it for 10 minutes at the temperature of 100° C.

Next, a coating liquid for a surface layer containing a charge transport material was prepared by dissolving 10 parts of charge transport material which has structure expressed in the following formula (CTM-2), 10 parts of polycarbonate resin (Tupilon Z-400, made by Mitsubishi Engineering-Plastics Corp.) [viscosity-average molecular weight (MV) 40,000], which was constructed of a repetition part expressed in the following formula (P-1), as a binder resin, in a mixed solvent of 65 parts of chlorobenzene, whose dipole moment was 1.0 or less, as an aromatic organic solvent (solvent A in Table 5), 0.1 parts of (methylsulfinyl)methane as an organic solvent (solvent B in Table 5) whose dipole moment was 2.8 or more, and 34.9 parts of dimethoxymethane as another solvent (solvent C in Table 5).

(CTM-2)

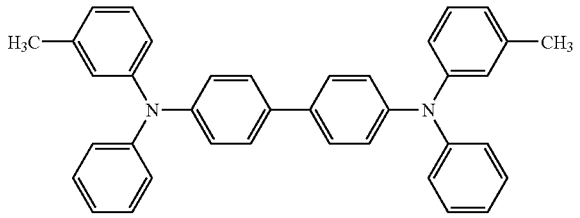

The step of preparing the coating liquid for a surface layer was performed in a state that relative humidity was 45% and ambient temperature was 25° C.

A step of dip-coating the coating liquid for a surface layer prepared as described above on the charge generation layer to coat the coating liquid for a surface layer on the cylindrical supporting member was performed. The step of coating the coating liquid for a surface layer was performed in a state that relative humidity was 45% and ambient temperature was 25° C.

After 20 seconds from an end of the coating step, the cylindrical supporting member on which the coating liquid for a surface layer was coated was held for 60 seconds inside an apparatus for the condensation step which was made beforehand into a state that relative humidity was 70% and ambient temperature was 25° C. inside the apparatus.

After 60 seconds from an end of the cylindrical supporting member holding step, the cylindrical supporting member was put into a blower dryer, inside which was heated at 120° C. beforehand, for the drying step to be performed for 60 minutes, and a charge transport layer at an average film thickness of 15 μm was formed in a position of 130 mm from an upper edge of the cylindrical supporting member.

In this way, the electrophotographic photosensitive member that the charge transport layer was a surface layer produced.

The same evaluation as that in Example 1 was performed for the electrophotographic photosensitive members produced by the above-mentioned production method. The result is shown in Table 5. (The major axis size in Table 5 shows an average major axis size. The depth in Table 5 shows the average value of the distance between the deepest part and aperture surface of the depressed portion. The uniformity in Table 5 shows (number of depressed portions which have 0.8 time or more of major axis size, or 1.2 times or less of major axis size to average major axis size per 100 μm square)/(number of total depressed portions per 100 μm square).)

As to the electrophotographic photosensitive member prepared by the above method, the remaining amount of the organic solvent whose dipole moment in the surface layer is 2.8 or more was measured by the following process. The measuring method employs a method comprising striping off the surface layer of the electrophotographic photosensitive member and detecting volatilization component in the surface layer chip obtained by means of head-space type gas chromatograph.

The surface layer of the electrophotographic photosensitive member which was prepared by the above method and was left for 3 hours was striped off, 0.5 g of the surface layer striped off was placed in a vial for 20 ml head-space, and then the vial was sealed by using a septum. The vial sealed was set on Head Space Sampler (HP7694 available from Hewlett-Packard Co.), and was heated for 30 minutes at 250° C. Then the sample was introduced into gas chromatography (HP6890 Series GC System available from Hewlett-Packard Co.) provided with capillary column (HP-5MS available from Yokokawa Analytical Systems Co.) to detect by gas chromatography. The determinate quantity was carried out as compared with the calibration curve using a sample for calibration curve separately prepared. As the result of measuring above method, 250 ppm of the organic solvent whose dipole moment is 2.8 or more was contained in the surface layer of the photosensitive member prepared in Example 14.

Examples 15 to 17

Electrophotographic photosensitive members were produced in the same manner as in Example 14 except that the solvent in a coating liquid for a surface layer, and the relative humidity and ambient temperature in the condensation step were changed to the conditions shown in Table 5, and were evaluated. The result is shown in Table 5.

The remaining amount of the organic solvent whose dipole moment in the surface layer is 2.8 or more was measured in the same manner as in Example 14. As the result, it was confirmed that the remaining amount of the organic solvent whose dipole moment in Example 15 was 1000 ppm, the remaining amount in Example 16 was 3000 ppm, and the remaining amount in Example 17 was 3000 ppm.

Example 18

Electrophotographic photosensitive member was produced in the same manner as in Example 14 except that the solvent in a coating liquid for a surface layer, and the relative humidity and ambient temperature in the condensation step were changed to the conditions shown in Table 5, and the cylindrical supporting member holding time was changed to 120 seconds, and was evaluated. The result is shown in Table 5.

As the result of measuring the remaining amount of the organic solvent whose dipole moment in the surface layer is 2.8 or more in the same manner as in Example 14, 10000 ppm of the remaining amount was confirmed.

Example 19

Electrophotographic photosensitive member was produced in the same manner as in Example 14 except that the solvent in a coating liquid for a surface layer, and the relative humidity and ambient temperature in the condensation step were changed to the conditions shown in Table 5, and the cylindrical supporting member holding time was changed to 15 seconds, and was evaluated. The result is shown in Table 5.

Examples 20 to 25

Electrophotographic photosensitive members were produced in the same manner as in Example 14 except that the solvent in a coating liquid for a surface layer, and the relative humidity and ambient temperature in the condensation step were changed to the conditions shown in Table 5, and were evaluated. The result is shown in Table 5.

Example 26

Electrophotographic photosensitive member was produced in the same manner as in Example 14 except that the solvent in a coating liquid for a surface layer, and the relative humidity and ambient temperature in the condensation step were changed to the conditions shown in Table 5, and the cylindrical supporting member holding time was changed to 10 seconds, and was evaluated. The result is shown in Table 5.

Examples 27 and 28

Electrophotographic photosensitive members were produced in the same manner as in Example 14 except that the solvent in a coating liquid for a surface layer, and the relative humidity and ambient temperature in the condensation step were changed to the conditions shown in Table 5, and were evaluated. The result is shown in Table 5.

Example 29

Electrophotographic photosensitive member was produced in the same manner as in Example 14 except that the solvent in a coating liquid for a surface layer, and the relative humidity and ambient temperature in the condensation step were changed to the conditions shown in Table 5, and the cylindrical supporting member holding time was changed to 90 seconds, and was evaluated. The result is shown in Table 5.

Example 30

Electrophotographic photosensitive member was produced in the same manner as in Example 14 except that the solvent in a coating liquid for a surface layer, and the relative humidity and ambient temperature in the condensation step were changed to the conditions shown in Table 5, and the cylindrical supporting member holding time was changed to 30 seconds, and was evaluated. The result is shown in Table 5.

Example 31

Electrophotographic photosensitive member was produced in the same manner as in Example 14 except that the temperature of a coating liquid for a surface layer was cooled in 18° C., the solvent in a coating liquid for a surface layer, and the relative humidity and ambient temperature in the condensation step were changed to the conditions shown in Table 5, and the cylindrical supporting member holding time was changed to 5 seconds, and was evaluated. The result is shown in Table 5.

Example 32

Electrophotographic photosensitive member was produced in the same manner as in Example 14 except that the temperature of a coating liquid for a surface layer was cooled in 18° C., the solvent in a coating liquid for a surface layer, and the relative humidity and ambient temperature in the condensation step were changed to the conditions shown in Table 5, and the cylindrical supporting member holding time was changed to 30 seconds, and was evaluated. The result is shown in Table 5.

TABLE 5

| | Solvent A [% by mass] | Solvent [% by mass] | Solvent C [% by mass] | Condensation step relative humidity [%] | Condensation step ambient temperature [° C.] | Surface depressed portion Major axis size [μm] | Depth [μm] | Uniformity |
|---|---|---|---|---|---|---|---|---|
| Ex. 14 | Chlorobenzene [65] | (Methyl sulfinyl)Methane [0.1] | Dimethoxy methane [34.9] | 70 | 25 | 0.8 | 1.1 | 0.99 |
| Ex. 15 | Chlorobenzene [65] | (Methyl sulfinyl)Methane [0.5] | Dimethoxy methane [34.5] | 70 | 25 | 3.6 | 3.0 | 0.98 |
| Ex. 16 | Chlorobenzene [65] | (Methyl sulfinyl)Methane [2.0] | Dimethoxy methane [33] | 70 | 45 | 5.7 | 4.8 | 0.97 |

TABLE 5-continued

| | Solvent A [% by mass] | Solvent [% by mass] | Solvent C [% by mass] | Condensation step relative humidity [%] | Condensation step ambient temperature [° C.] | Surface depressed portion Major axis size [μm] | Depth [μm] | Uniformity |
|---|---|---|---|---|---|---|---|---|
| Ex. 17 | Chlorobenzene [65] | (Methyl sulfinyl)Methane [2.0] | Dimethoxy methane [33] | 50 | 25 | 3.1 | 2.9 | 0.99 |
| Ex. 18 | Chlorobenzene [65] | (Methyl sulfinyl)Methane [5.0] | Dimethoxy methane [30] | 50 | 25 | 7.4 | 6.3 | 0.90 |
| Ex. 19 | Chlorobenzene [65] | (Methyl sulfinyl)Methane [2.0] | Dimethoxy methane [33] | 50 | 25 | 0.5 | 0.3 | 0.95 |
| Ex. 20 | Chlorobenzene [65] | Thiolane-1,1-dione [2.0] | Dimethoxy methane [33] | 60 | 25 | 4.7 | 6.0 | 0.99 |
| Ex. 21 | Chlorobenzene [65] | N,N-dimethyl carboxy amide [2.0] | Dimethoxy methane [33] | 50 | 25 | 4.3 | 3.7 | 0.99 |
| Ex. 22 | Chlorobenzene [65] | N,N-diethyl carboxy amide [2.0] | Dimethoxy methane [33] | 50 | 25 | 6.0 | 4.3 | 0.99 |
| Ex. 23 | Chlorobenzene [65] | Dimethyl acetamide [2.0] | Dimethoxy methane [33] | 50 | 25 | 3.8 | 3.5 | 0.98 |
| Ex. 24 | Chlorobenzene [65] | 1-methyl pyrrolidine2-one [2.0] | Dimethoxy methane [33] | 50 | 25 | 5.0 | 4.0 | 0.98 |
| Ex. 25 | Chlorobenzene [65] | Phosphinotris (dimethyl amino)-1-one [2.0] | Dimethoxy methane [33] | 50 | 25 | 1.5 | 0.5 | 0.93 |
| Ex. 26 | Chlorobenzene [65] | 2-methyl-pentane-2,4-diol [2.0] | Dimethoxy methane [33] | 50 | 25 | 0.4 | 0.4 | 0.93 |
| Ex. 27 | 1,3-dimethylbenzene [65] | (Methyl sulfinyl(Methane [2.0] | Dimethoxy methane [33] | 50 | 25 | 3.2 | 1.7 | 0.97 |
| Ex. 28 | 1,2-dimethylbenzene [65] | (Methyl sulfinyl)Methane [2.0] | Dimethoxy methane [33] | 50 | 25 | 2.8 | 3.4 | 0.96 |
| Ex. 29 | 1,3-dimethylbenzene [65] | (Methyl sulfinyl)Methane [2.0] | Oxolane [33] | 50 | 45 | 3.5 | 5.0 | 0.92 |
| Ex. 30 | 1,2-dimethylbenzene [[65] | (Methyl sulfinyl)Methane [2.0] | Oxolane [33] | 70 | 45 | 0.4 | 1.6 | 0.92 |
| Ex. 31 | Chlorobenzene [65] | (Methyl sulfinyl)Methane [2.0] | Dimethoxy methane [33] | 50 | 25 | 2.0 | 1.0 | 0.98 |
| Ex. 32 | Chlorobenzene [65] | (Methyl sulfinyl)Methane [3.0] | Dimethoxy methane [32] | 45 | 23 | 3.2 | 1.6 | 0.98 |

From the above-mentioned result of Examples 14 to 32 of the present invention, it turns out that an electrophotographic photosensitive member which has highly uniform depressed portions on the electrophotographic photosensitive member can be produced by using the coating liquid for a surface layer which contains the binder resin and the aromatic organic solvent, whose dipole moment is 1.0 or less, in the present invention, in which content of the aromatic organic solvent is 50% by mass or more and 80% by mass or less based on the total mass of solvents, and which contains an organic solvent (solvent B) whose dipole moment is 2.8 or more.

In addition, when Examples 17 to 29, 31, and 32 of the present invention are compared with Comparative Example 7, it turns out that highly uniform depressed portions are formed in an electrophotographic photosensitive member surface by containing the organic solvent (solvent B), whose dipole moment is 2.8 or more, in a coating liquid for a surface layer, even if the condensation step is performed in a state that relative humidity is low. It is conceivable that this is because liquid droplet formation with high uniformity is efficiently performed in the condensation step since the organic solvent (solvent B) whose dipole moment is 2.8 or more exists in a surface layer coating liquid.

Example 33

An aluminum cylinder (Japanese Industrial Standards-A3003, ED pipe of an aluminum alloy made by Showa Aluminum Co., Ltd.) in 260.5 mm of length and 30 mm of diameter which was obtained by performing hot extrusion under an environment of 23° C. and 60% was used as a conductive cylindrical supporting member.

A dispersion liquid was prepared by dispersing 6.6 parts of $TiO_2$ particles (powder resistivity: 80 Ω·cm, and a coverage (a mass rate) of $SnO_2$ is 50%) which covered oxygen deficiency type $SnO_2$ as conductive particles, 5.5 parts of phenolic resin as a binder resin (trade name: Plyofen J-325, made by Dainippon Ink & Chemicals, Inc., 60% of resin solid content), and 5.9 parts of methoxypropanol as a solvent with a sand mill, using glass beads at a diameter of 1 mm, for 3 hours.

A coating liquid for conductive layers was prepared by adding 0.5 parts of silicone resin particles (trade name: Tospearl 120, made by GE Toshiba Silicones Co., Ltd., average particle diameter of 2 μm) as a surface roughing additive, and 0.001 parts of silicone oil (trade name: SH28PA, made by TORAY DOW CORNING SILICONE Co., Ltd.) as a leveling agent, to this dispersion liquid, and stirring them.

A conductive layer at an average film thickness of 15 μm was formed in a position of 130 mm from an upper edge of the conductive cylindrical supporting member by dip coating this coating liquid for a conductive layer on the conductive cylindrical supporting member, and drying and heat-hardening it for 30 minutes at the temperature of 140° C.

Furthermore, on the conductive layer, an intermediate layer whose average film thickness in a 130-mm position from an upper edge of the cylindrical supporting member is 0.5 μm is formed by dip-coating a coating liquid for an intermediate layer which was obtained by dissolving 4 parts of N-methoxy methylation nylon (trade name: Tresin EF-30T, made by Teikoku Chemical K.K.), and 2 parts of copolymerization nylon resin (Amilan CM8000, made by Toray Industries, Inc.) in a mixed solvent of 65 parts of methanol and 30 parts of n-butanol, and drying it for 10 minutes at the temperature of 100° C.

Next, a coating liquid for a charge generation layer was prepared by dispersing 10 parts of hydroxygallium phthalocyanine having a crystal form which has strong peaks at Bragg angles (2θ±0.2°) of 7.5°, 9.9°, 16.3°, 18.6°, 25.1°, and 28.3° in CuKα characteristic X-ray diffraction, 5 parts of polyvinyl butyral (trade name: S-LEC BX-1, made by Sekisui Chemical Co., Ltd.), and 250 parts of cyclohexanone with a sand mill, using glass beads at a diameter of 1 mm, for one hour, and next applying 250 parts of ethyl acetate.

A charge generation layer at an average film thickness of 0.16 μm was formed in a position of 130 mm from an upper edge of the cylindrical supporting member by dip coating this coating liquid for a charge generation layer on the intermediate layer, and drying it for 10 minutes at the temperature of 100° C.

Next, a coating liquid for a surface layer containing a charge transport material was prepared by dissolving 10 parts of charge transport material which has structure expressed in the following formula (CTM-1), 10 parts of polycarbonate resin (Tupilon Z-400, made by Mitsubishi Engineering-Plastics Corp.) [viscosity-average molecular weight (MV): 40,000], which was constructed of a repetition part expressed in the following formula (P-1), as a binder resin, in a mixed solvent of 65 parts of chlorobenzene as an aromatic organic solvent (solvent A in Table 6) whose dipole moment was 1.0 or less, 0.1 parts of water, and 34.9 parts of dimethoxymethane as another solvent (solvent C in Table 6). The step of preparing the coating liquid for a surface layer was performed in a state that relative humidity was 45% and ambient temperature was 25° C.

A step of dip-coating the coating liquid for a surface layer prepared as described above on the charge generation layer to coat the coating liquid for a surface layer on the cylindrical supporting member was performed. The step of coating the coating liquid for a surface layer was performed in a state that relative humidity was 45% and ambient temperature was 25° C.

After 180 seconds from an end of the coating step, the cylindrical supporting member on which the coating liquid for a surface layer was coated was held for 180 seconds inside an apparatus for the condensation step which was made beforehand into a state that relative humidity was 50% and ambient temperature was 25° C. inside the apparatus.

After 60 seconds from an end of the condensation step, the cylindrical supporting member was put into a blower dryer, inside which was heated at 120° C. beforehand, for the drying step to be performed for 60 minutes, and a charge transport layer at an average film thickness of 15 μm was formed in a position of 130 mm from an upper edge of the cylindrical supporting member.

In this way, the electrophotographic photosensitive member that the charge transport layer was a surface layer produced.

The same evaluation as that in Example 1 was performed for the electrophotographic photosensitive members produced by the above-mentioned production method. The result is shown in Table 6. (The major axis size in Table 6 shows an average major axis size. The depth in Table 6 shows the average value of the distance between the deepest part and aperture surface of the depressed portion. The uniformity in Table 6 shows (number of depressed portions which have 0.8 time or more of major axis size, or 1.2 times or less of major axis size to average major axis size per 100 μm square)/(number of total depressed portions per 100 μm square).)

Example 34

Electrophotographic photosensitive member was produced in the same manner as in Example 33 except that the solvent in a coating liquid for a surface layer, and the relative humidity and ambient temperature in the condensation step were changed to the conditions shown in Table 6, and was evaluated. The result is shown in Table 6.

Example 35

Electrophotographic photosensitive member was produced in the same manner as in Example 33 except that the solvent in a coating liquid for a surface layer, and the relative humidity and ambient temperature in the condensation step were changed to the conditions shown in Table 6, and the cylindrical supporting member holding time was changed to 90 seconds, and was evaluated. The result is shown in Table 6.

Examples 36 to 38

Electrophotographic photosensitive members were produced in the same manner as in Example 33 except that the solvent in a coating liquid for a surface layer, and the relative humidity and ambient temperature in the condensation step were changed to the conditions shown in Table 6, and were evaluated. The result is shown in Table 6.

TABLE 6

| | Solvent A [% by mass] | Water [% by mass] | Solvent C [% by mass] | Condensation step relative humidity [%] | Condensation step ambient temperature [° C.] | Surface depressed portion Major axis size [μm] | Depth [μm] | Uniformity |
|---|---|---|---|---|---|---|---|---|
| Ex. 33 | Chlorobenzene [65] | [0.1] | Dimethoxy methane [34.9] | 50 | 25 | 3.2 | 3.6 | 0.97 |
| Ex. 34 | Chlorobenzene [65] | [0.5] | Dimethoxy methane [34.5] | 50 | 25 | 4.5 | 3.9 | 0.94 |

TABLE 6-continued

| | Solvent A [% by mass] | Water [% by mass] | Solvent C [% by mass] | Condensation step relative humidity [%] | Condensation step ambient temperature [° C.] | Surface depressed portion Major axis size [μm] | Depth [μm] | Uniformity |
|---|---|---|---|---|---|---|---|---|
| Ex. 35 | Chlorobenzene [65] | [0.5] | Dimethoxy methane [34.5] | 70 | 25 | 1.7 | 3.5 | 0.96 |
| Ex. 36 | Chlorobenzene [65] | [2.0] | Dimethoxy methane [33] | 50 | 25 | 7.8 | 1.5 | 0.90 |
| Ex. 37 | 1,3-dimethylbenzene [65] | [0.5] | Dimethoxy methane [34.5] | 50 | 25 | 6.0 | 5.0 | 0.90 |
| Ex. 38 | 1,2-dimethylbenzene [65] | [0.5] | Dimethoxy methane [34.5] | 50 | 25 | 4.6 | 3.5 | 0.92 |

From the above-mentioned result of Examples 33 to 38 of the present invention, it turns out that an electrophotographic photosensitive member which has highly uniform depressed portions on the electrophotographic photosensitive member can be produced by using the coating liquid for a surface layer which contains the binder resin and the aromatic organic solvent, whose dipole moment is 1.0 or less, in the present invention, in which content of the aromatic organic solvent is 50% by mass or more and 80% by mass or less based on the total mass of solvents, and which further contains water.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-016215, filed Jan. 26, 2007, and No. 2007-121499, filed May 2, 2007 which are hereby incorporated by reference herein in their entirety.

What is claimed is:

1. A production method of an electrophotographic photosensitive member which has a photosensitive layer formed on a cylindrical supporting member, characterized by producing a surface layer of the electrophotographic photosensitive member, the surface layer having surface depressed portions which are formed by:

(1) producing a coating liquid which contains a binder resin and an aromatic organic solvent (A) whose dipole moment found by dipole moment calculation by structure optimized-calculation using semiempirical molecular orbital calculation is 1.0 or less, and in which the content of the aromatic organic solvent is 50% by mass or more and 80% by mass or less based on the total mass of solvents in the coating liquid, and coating the coating liquid on a layer to form the surface layer, (2) condensing the surface of the surface layer to form liquid droplets and the depressed portions thereon, and (3) drying the surface layer after the depressed portions are formed by condensation.

2. The production method of an electrophotographic photosensitive member according to claim 1, characterized in that the layer on which the coating liquid is coated is held under an ambient atmosphere of a relative humidity at 70% or more in the condensing step (2).

3. The production method of an electrophotographic photosensitive member according to claim 1, characterized in that, in producing the coating liquid, the coating liquid further contains an organic solvent (B) whose dipole moment found by dipole moment calculation by structure optimized-calculation using semiempirical molecular orbital calculation is 2.8 or more at 0.1% by mass or more and 15.0% by mass or less based on the total mass of solvents in the coating liquid.

4. The production method of an electrophotographic photosensitive member according to claim 3, characterized in that a boiling point of the organic solvent (B) is equal to or higher than a boiling point of the aromatic organic solvent (A).

5. The production method of an electrophotographic photosensitive member according to claim 3, characterized in that dipole moment of the organic solvent (B) which is found by dipole moment calculation by structure optimized-calculation using semiempirical molecular orbital calculation is 3.2 or more.

6. The production method of an electrophotographic photosensitive member according to claim 1, characterized in that, in producing the coating liquid, the coating liquid further contains water at 0.1% by mass or more and 2.0% by mass or less based on the total mass of solvents in the coating liquid.

7. The production method of an electrophotographic photosensitive member according to claim 1, characterized in that the aromatic organic solvent (A) is a solvent selected from among 1,2-dimethylbenzene, 1,3-dimethylbenzene, 1,4-dimethylbenzene, 1,3,5-trimethylbenzene, and chlorobenzene.

* * * * *

UNITED STATES PATENT AND TRADEMARK OFFICE

CERTIFICATE OF CORRECTION

PATENT NO. : 7,413,840 B1
APPLICATION NO. : 11/770081
DATED : August 19, 2008
INVENTOR(S) : Harunobu Ogaki et al.

It is certified that error appears in the above-identified patent and that said Letters Patent is hereby corrected as shown below:

COLUMN 2

Line 43, “wave form” should read --wave form.--.

COLUMN 4

Line 51, “layer” should read --layer.--.

COLUMN 5

Line 59, “Dipole” should read --<Dipole--.

COLUMN 7

Line 4, “mixed” should read --mixed.--.

COLUMN 10

Line 7, “water” should read --water.--.

COLUMN 12

Line 2, “pm” should read --μm--.

COLUMN 25

Line 48, “(Tupilon” should read --(Iupilon--.

COLUMN 29

Table 5, Exhibit 27, “Ex. 27 1,3-dimethylbenzene (Methyl [65] sulfinyl(Methane [2.0]”
should read --Ex. 27 1,3-dimethylbenzene (Methyl [65] sulfinyl)Methane [2.0]--.

UNITED STATES PATENT AND TRADEMARK OFFICE

CERTIFICATE OF CORRECTION

PATENT NO. : 7,413,840 B1
APPLICATION NO. : 11/770081
DATED : August 19, 2008
INVENTOR(S) : Harunobu Ogaki et al.

It is certified that error appears in the above-identified patent and that said Letters Patent is hereby corrected as shown below:

COLUMN 31

Line 42, "(Tupilon" should read --(Iupilon--.

Signed and Sealed this

Twenty-fourth Day of February, 2009

JOHN DOLL
*Acting Director of the United States Patent and Trademark Office*